US009883273B2

(12) United States Patent
Kang et al.

(10) Patent No.: US 9,883,273 B2
(45) Date of Patent: Jan. 30, 2018

(54) ELECTRONIC DEVICE AND METHOD OF OPERATING ELECTRONIC DEVICE

(71) Applicant: Samsung Electronics Co., Ltd., Gyeonggi-do (KR)

(72) Inventors: Seung-Beom Kang, Gyeonggi-do (KR); Yong-Yi Kim, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/187,311

(22) Filed: Jun. 20, 2016

(65) Prior Publication Data

US 2016/0373870 A1 Dec. 22, 2016

(30) Foreign Application Priority Data

Jun. 18, 2015 (KR) ..... 10-2015-0086919

(51) Int. Cl.
*H04R 1/10* (2006.01)
*H04R 3/12* (2006.01)

(52) U.S. Cl.
CPC ..... *H04R 1/1025* (2013.01); *H04R 1/1016* (2013.01); *H04R 1/1041* (2013.01); *H04R 3/12* (2013.01); *H04R 2420/09* (2013.01); *H04R 2460/03* (2013.01); *H04R 2460/07* (2013.01)

(58) Field of Classification Search
CPC .. H04R 1/1025; H04R 1/1041; H04R 1/1016; H04R 3/12; H04R 2460/07; H04R 2460/03; H04R 2420/09
See application file for complete search history.

(56) References Cited

U.S. PATENT DOCUMENTS

2014/0037102 A1* 2/2014 Alanis ..... H04R 1/1041 381/74
2015/0146908 A1* 5/2015 Kalhok ..... H04R 1/1041 381/374
2015/0230019 A1* 8/2015 Sakai ..... H04R 1/1041 381/74
2015/0312668 A1* 10/2015 White ..... H04R 1/1033 381/374
2016/0373849 A1* 12/2016 Stoch ..... H04R 1/105

FOREIGN PATENT DOCUMENTS

CN 203301710 11/2013

* cited by examiner

*Primary Examiner* — Muhammad N Edun
(74) *Attorney, Agent, or Firm* — The Farrell Law Firm, P.C.

(57) ABSTRACT

The present disclosure relates to an electronic device and a method of operating the same. The electronic device includes a necklace band, and a first component connected to the necklace band. The first component includes a first magnet located on a first surface of a housing of the first component, a first connection unit located on the first surface of the housing of the first component, and electrically connectable to a second connection unit located on a first surface of a housing of a second component, and a controller configured to connect the first connection unit and the second connection unit when the first magnet is attached to a second magnet located on the first surface of the housing of the second component, and receive power from the second component through the first connection unit connected with the second connection unit.

20 Claims, 20 Drawing Sheets

ELECTRONIC DEVICE AND METHOD OF OPERATING ELECTRONIC DEVICE

PRIORITY

This application claims priority under 35 § 119(a) to Korean Patent Application Serial No. 10-2015-0086919, which was filed in the Korean Intellectual Property Office on Jun. 18, 2015, the entire content of which is incorporated herein by reference.

BACKGROUND

1. Field of the Disclosure

The present disclosure relates generally to an electronic device and a method of operating the electronic device.

2. Description in the Related Art

In recent years, various electronic devices, which can be directly worn on a body, have been developed. An electronic device, which can be directly worn on a body, is referred to as a wearable electronic device. The wearable electronic device may include for example, a head mounted display, a smart glass, a smart watch or wristband, a necklace-type apparatus, a contact lens-type apparatus, a ring-type apparatus, a shoe-type apparatus, a cloth-type apparatus, and a glove-type apparatus, and can be attached/detached to/from a part of the body or clothes.

Since a user should be able to simply and conveniently access a wearable electronic device and use the wearable electronic device anytime and anywhere while wearing the wearable electronic device, the shape of the wearable electronic device has been miniaturized.

Further, since it is difficult to mount a large capacity battery to the interior of a wearable electronic device, the wearable electronic device has a small capacity battery mounted thereto and can only operate a simple function.

Therefore, the wearable electronic device has a limitation in that it is difficult to provide complex functions requiring a large amount of battery consumption without external power. Further, when using an internal battery, the wearable electronic device presents an inconvenience in that the battery must be frequently charged due to a short use time period, and as a result, a user may need to carry an auxiliary battery.

SUMMARY

The present disclosure has been made to address at least the above-mentioned problems and/or disadvantages and to provide at least the advantages described below.

Accordingly, an aspect of the present disclosure is to provide an electronic device which can be worn on the body of a user and has simple and convenient mobility and accessibility, and a method of operating the electronic device.

Accordingly, another aspect of the present disclosure is to provide an electronic device configured in a wearable form, which can be conveniently attached/detached using a magnet so that the electronic device can be conveniently worn on a body of a user and thus provide simple and convenient mobility and accessibility.

Accordingly, another aspect of the present disclosure is to provide an electronic device configured in a wearable form which allows for a plurality of external batteries to be easily attached/detached to the electronic device and then used, so that the electronic device can simply and conveniently receive power for charging a battery thereof and for operating the electronic device.

In accordance with an aspect of the present disclosure, an electronic device is provided. The electronic device includes a necklace band, and a first component connected to the necklace band. The first component includes a first magnet located on a first surface of the first component, a first connection unit located on a first surface of the first component and a controller. The first component electrically connectable to a second connection unit located on the one surface of the housing of a second component. The controller connects the first connection unit and the second connection unit, when the first magnet is attached a second magnet located on a first surface of the second component, and receives power from the second component through the first connection unit connected with the second connection unit.

In accordance with another aspect of the present disclosure, a method of operating an electronic device is provided. The method includes connecting a first connection unit included in a first component of an electronic device and a second connection unit included in a second component, when the first component is attached to the second component using a first magnet of the first component and a second magnet of the second component, and receiving, by the first connection unit of the first component, power from the second connection unit of the second component.

In accordance with another aspect of the present disclosure, a non-transitory computer-readable recording medium in which a program to be performed on a computer is recorded is provided. The program includes executable commands for connecting a first connection unit included in a first component of an electronic device and a second connection unit included in a second component, when the first component is attached to the second component using a first magnet of the first component and a second magnet of the second component, and receiving, by the first connection unit of the first component, power from the second connection unit of the second component.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF EMBODIMENTS OF THE PRESENT DISCLOSURE

Figure 1:
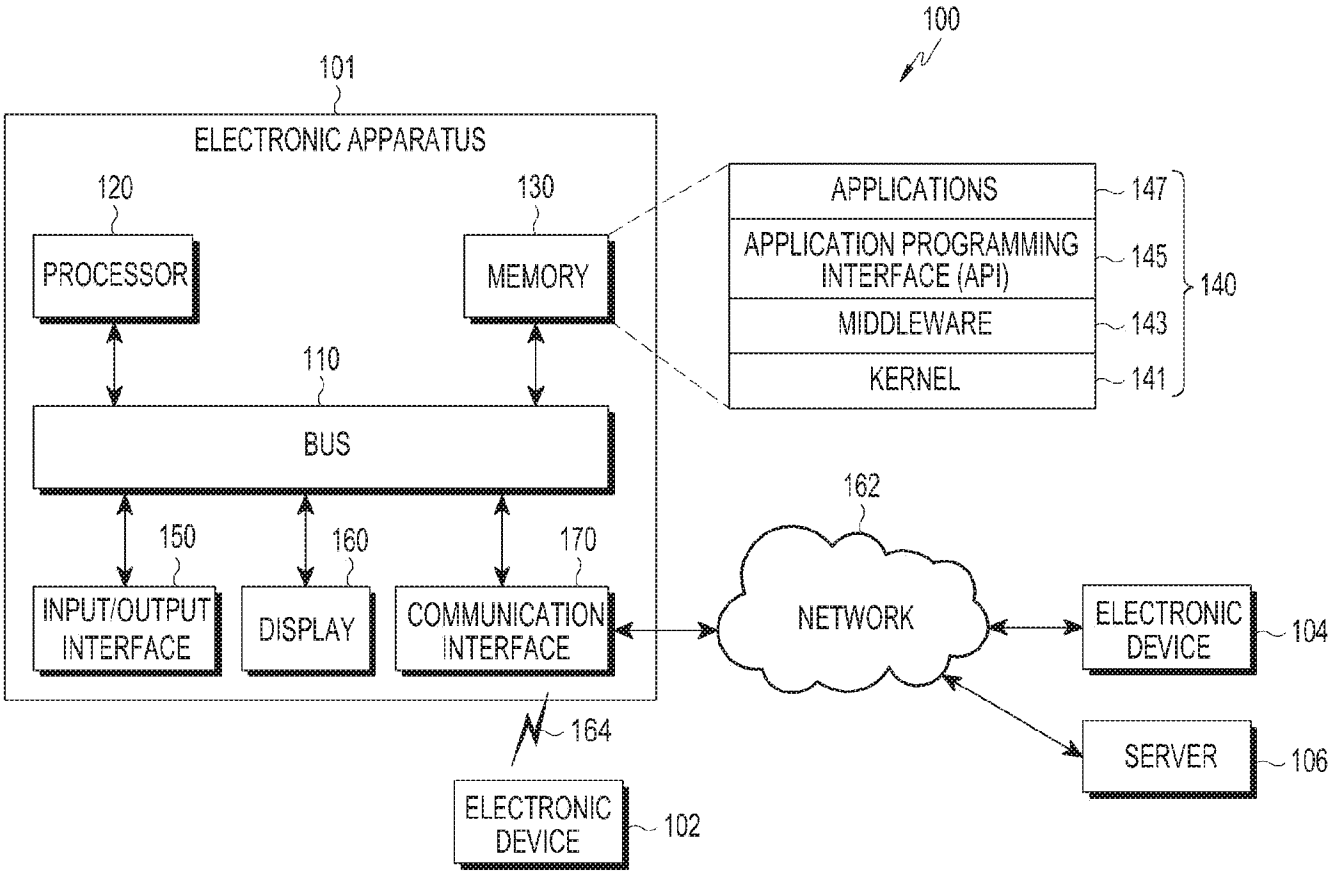
FIG. 1 is a block diagram of a configuration of a network environment, according to an embodiment of the present disclosure.

Hereinafter, various embodiments of the present disclosure will be described with reference to the accompanying drawings. However, it should be understood that there is no intent to limit the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

As used herein, the expressions "have", "may have", "include", and "may include" refer to the existence of a corresponding feature (e.g., numeral, function, operation, or constituent element such as component), and do not exclude one or more additional features.

In the present disclosure, the expressions "A or B", "at least one of A or/and B", and "one or more of A or/and B" may include all possible combinations of the items listed. For example, the expressions "A or B", "at least one of A and B", and "at least one of A or B" refers to all of (1) including A, (2) including B, or (3) including all of A and B.

The expressions "a first", "a second", "the first", "the second", etc, used in describing various embodiments of the present disclosure may modify various components regardless of the order and/or the importance, but do not limit the corresponding components. For example, a first user device and a second user device indicate different user devices although both of them are user devices. For example, a first element may be referred to as a second element, and similarly, a second element may be referred to as a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposed between the first and second elements. In contrast, it may be understood that when an element (e.g., first element) is referred to as being "directly connected," or "directly coupled" to another element (second element), there are no element (e.g., third element) interposed between the first and second elements.

The expression "configured to" used in the present disclosure may be used interchangeably with, for example, "suitable for", "having the capacity to", "designed to", "adapted to", "made to", or "capable of" according to the situation. The term "configured to" may not necessarily imply "specifically designed to" in hardware. In some situations, the expression "device configured to" may mean that the device, together with other devices or components, "is able to". For example, the phrase "processor adapted or configured) to perform A, B, and C" may mean a dedicated processor (e.g. embedded processor) only for performing the corresponding operations or a generic-purpose processor (e.g., central processing unit (CPU) or application processor (AP)) that can perform the corresponding operations by executing one or more software programs stored in a memory device.

The terms used herein are merely for the purpose of describing particular embodiments and are not intended to limit the scope of other embodiments. As used herein, singular forms may include plural forms as well, unless the context clearly indicates otherwise. Unless defined otherwise, all terms used herein, including technical and scientific terms, have meanings equivalent to those commonly understood by a person skilled in the art to which the present disclosure pertains. Such terms as those defined in a generally used dictionary may be interpreted to have meanings equivalent to the contextual meanings in the relevant field of art, and are not to be interpreted to have ideal or excessively formal meanings, unless clearly defined in the present disclosure. In some cases, even terms defined in the present disclosure should not be interpreted to exclude embodiments of the present disclosure.

An electronic device according to various embodiments of the present disclosure may include at least one of a smart phone, a tablet Personal Computer (PC), a mobile phone, a video phone, an electronic book reader (e-bookreader), a desktop PC, a laptop PC, a netbook computer, a workstation, a server, a Personal Digital Assistant (PDA), a Portable Multimedia Player (PMP), a MPEG-1 audio layer-3 (MP3) player, a mobile medical device, a camera, and a wearable device. The wearable device may include at least one of an accessory type (e.g., a watch, a ring, a bracelet, an anklet, a necklace, a glasses, a contact lens, or a Head-Mounted Device (HMD)), a fabric or clothing integrated type (e.g., an electronic clothing), a body-mounted type (e.g., a skin pad, or tattoo), and a bio-implantable type (e.g., an implantable circuit).

According to some embodiments of the present disclosure, the electronic device may be a home appliance. The home appliance may include at least one of a television, a Digital Video Disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

According to another embodiment of the present disclosure, the electronic device may include at least one of various medical devices (e.g., various portable medical measuring devices (a blood glucose monitoring device, a heart rate monitoring device, a blood pressure measuring device, a body temperature measuring device, etc.), a Magnetic Resonance Angiography (MRA), a Magnetic Resonance Imaging (MRI), a Computed Tomography (CT) machine, and an ultrasonic machine), a navigation device, a Global Positioning System (GPS) receiver, an Event Data Recorder (EDR), a Flight Data Recorder (FDR), a Vehicle infotainment Device, an electronic device for a ship (e.g., a navigation device for a ship, and a gyro-compass), avionic device, a security device, an automotive head unit, a robot for home or industry, an automatic teller machine (ATM), a point of sales (POS) machine, or an Internet of Things (IoT) device (e.g., a light bulb, various sensors, electric or gas meter, a sprinkler device, a fire alarm, a thermostat, a streetlamp, a toaster, a sporting goods, a hot water tank, a heater, a boiler, etc.).

According to some embodiments of the present disclosure, the electronic device may include at least one of a part of furniture or a building/structure, an electronic board, an electronic signature receiving device, a projector, and various kinds of measuring instruments (e.g., a water meter, an electric meter, a gas meter, and a radio wave meter).

In various embodiments of the present disclosure, the electronic device may be a combination of one or more of the aforementioned various devices. The electronic device may be a flexible device. Further, the electronic device is not limited to the aforementioned devices, and may include a new electronic device according to the development of new technologies.

Hereinafter, an electronic device according to various embodiments will be described with reference to the accompanying drawings. As used herein, the term "user" may indicate a person who uses an electronic device or a device (e.g., an artificial intelligence electronic device) that uses an electronic device.

FIG. 1 is a block diagram of a configuration of a network environment, according to an embodiment of the present disclosure.

Referring to FIG. 1, an electronic device 101 in a network environment 100 is provided. The electronic device 101 includes a bus 110, a processor 120, a memory 130, an input/output interface 150, a display 160, and a communication interface 170. In some embodiments, the electronic device 101 may omit at least one of the components or may further include other components.

The bus 110 includes a circuit for interconnecting the components 110 to 170 and transferring communication (e.g., control messages and/or data) between the components.

The processor 120 includes one or more of a Central Processing Unit (CPU), an Application Processor (AP), and a Communication Processor (CP). The processor 120 executes operations or data processing related to the control and/or communication of at least one other component of the electronic device 101.

The memory 130 includes a volatile memory and/or a non-volatile memory. The memory 130 stores instructions or data related to at least one other component of the electronic device 101. The memory 130 can store software and/or a program 140. The program 140 includes a kernel 141, a middleware 143, an Application Programming Interface (API) 145, and/or an applications 147. At least some of the kernel 141, the middleware 143, and the API 145 may be referred to as an Operating System (OS).

The kernel 141 controls or manages system resources (e.g., the bus 110, the processor 120, or the memory 130) that are used for executing an operation or function implemented by the other programs (e.g., the middleware 143, the API 145, or the application programs 147). Further, the kernel 141 may provide an interface through which the middleware 143, the API 145, or the application programs 147 can access the individual components of the electronic device 101 to control or manage the system resources.

The middleware 143 functions as an intermediary for allowing the API 145 or the applications 147 to communicate with the kernel 141 to exchange data.

In addition, the middleware 143 processes one or more task requests received from the applications 147 according to priorities thereof. For example, the middleware 143 assigns priorities for using the system resources (e.g., the bus 110, the processor 120, the memory 130, etc.) of the electronic device 101, to at least one of the applications 147. For example, the middleware 143 executes scheduling or load balancing on the one or more task requests by processing the one or more task requests according to the priorities assigned thereto.

The API 145 is an interface through which the applications 147 control functions provided from the kernel 141 or the middleware 143, and includes, at least one interface or function (e.g., instruction) for file control, window control, image processing, or text control.

The input/output interface 150 functions as an interface that can transfer instructions or data input from a user or another external device, such as the first external electronic device 102 and the second external electronic device 104, to the other components of the electronic device 101. Further, the input/output interface 150 may output instructions or data received from the other components of the electronic device 101 to the user or the other external device.

The display 160 displays various types of contents (for example, text, images, videos, icons, or symbols) for the user. The display 160 may include a touch screen, and may receive a touch, gesture, proximity, or hovering input by using an electronic pen or a part of the user's body. Examples of the display 160 include a Liquid Crystal Display (LCD), a Light-Emitting Diode (LED) display, an Organic Light-Emitting Diode (OLED) display, a Micro-ElectroMechanical Systems (MEMS) display, and an electronic paper display.

The communication interface 170 configures communication between the electronic device 101 and the first external electronic device 102, the second external electronic device 104, or a server 106. For example, the communication interface 170 may be connected to a network 162 through wireless or wired communication to communicate with the second external electronic device 104 or the server 106.

The wireless communication, which is a cellular communication protocol, can use at least one of Long Term Evolution (LIE), LIE-Advance (LTE-A), Code Division Multiple Access (CDMA), Wideband CDMA (WCDMA), Universal Mobile Telecommunications System (UMTS), WiBro (Wireless Broadband), and Global System for Mobile Communications (GSM). In addition, the wireless communication may include short range communication 164. The short range communication 164 may include at least one of Wi-Fi, Bluetooth, Near Field Communication (NFC), Global Navigation Satellite System (GNSS), etc. The GNSS may include at least one of a Global Positioning System (GPS), a Global Navigation Satellite System (Glonass), a Beidou Navigation Satellite System (Beidou), and a European Global Satellite-based Navigation System (Galileo), according to a use area, a bandwidth, etc. Hereinafter, the "GPS" may be interchangeably used with the "GNSS".

The wired communication may include at least one of a Universal Serial Bus (USB), a High Definition Multimedia Interface (HDMI), Recommended Standard 232 (RS-232), and a Plain Old Telephone Service (POTS).

The network 162 may include at least one of a communication network, such as a computer network (e.g., a LAN or a WAN), the Internet, and a telephone network.

Each of the first and second external electronic apparatuses 102 and 104 may be of a type identical to or different from that of the electronic apparatus 101. The server 106 may include a group of one or more servers.

According to an embodiment of the present disclosure, all or some of the operations executed in the electronic device 101 can be performed in another electronic device or a plurality of electronic devices 102, 104, or the server 106. When the electronic device 101 should perform some functions or services automatically or in response to a request, the electronic device 101 can make a request for performing at least some functions relating thereto to another device 102, 104, or the server 106 instead of executing the functions or services by itself or in addition. The other external electronic device 102, 104, or the server 106 can execute the requested functions or the additional functions, and can transfer a result of the execution to the electronic apparatus 101. The electronic device 101 may process the received result as it is or additionally in order to provide the requested functions or services. To this end cloud computing, distributed computing, or client-server computing technology may be used.

Figure 2:
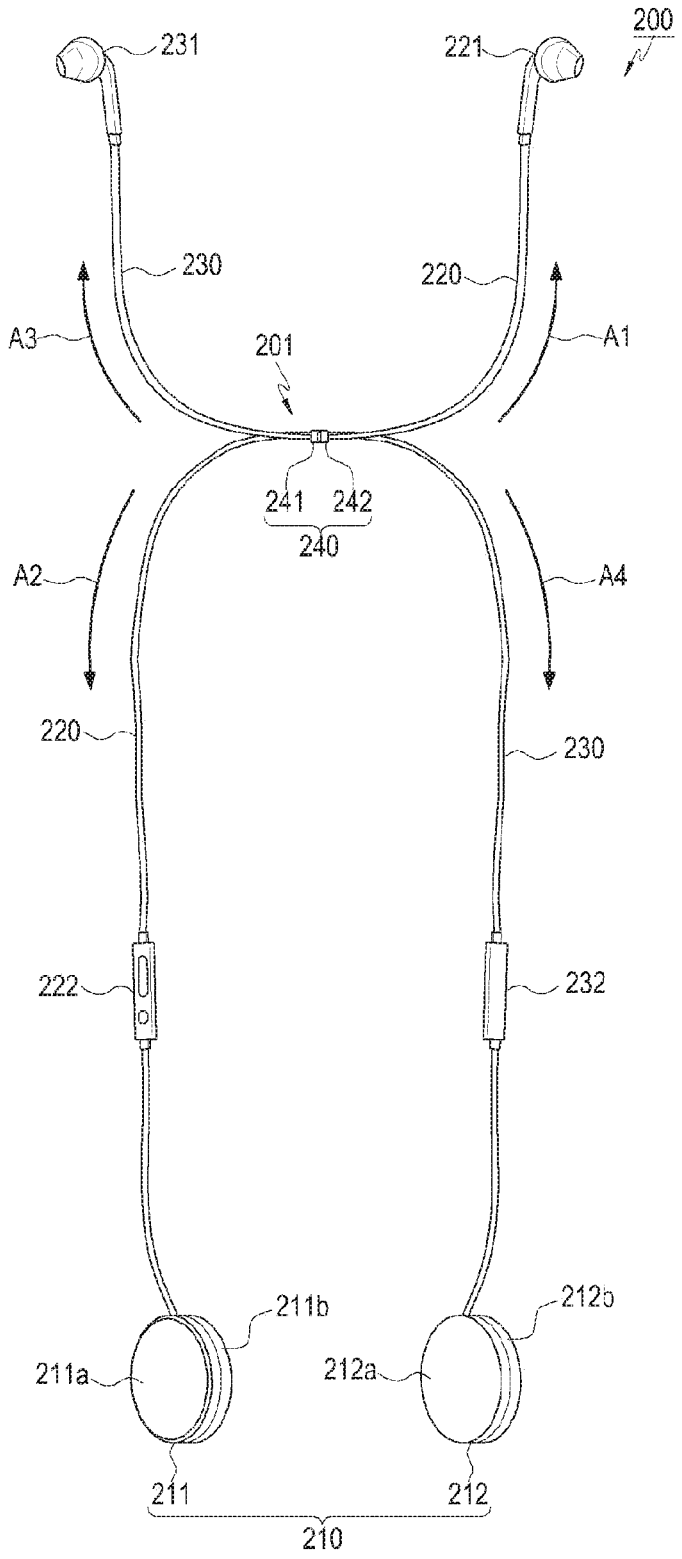
FIGS. 2 and 3 illustrate a configuration of an electronic device, according to an embodiment of the present disclosure.
Figure 3:
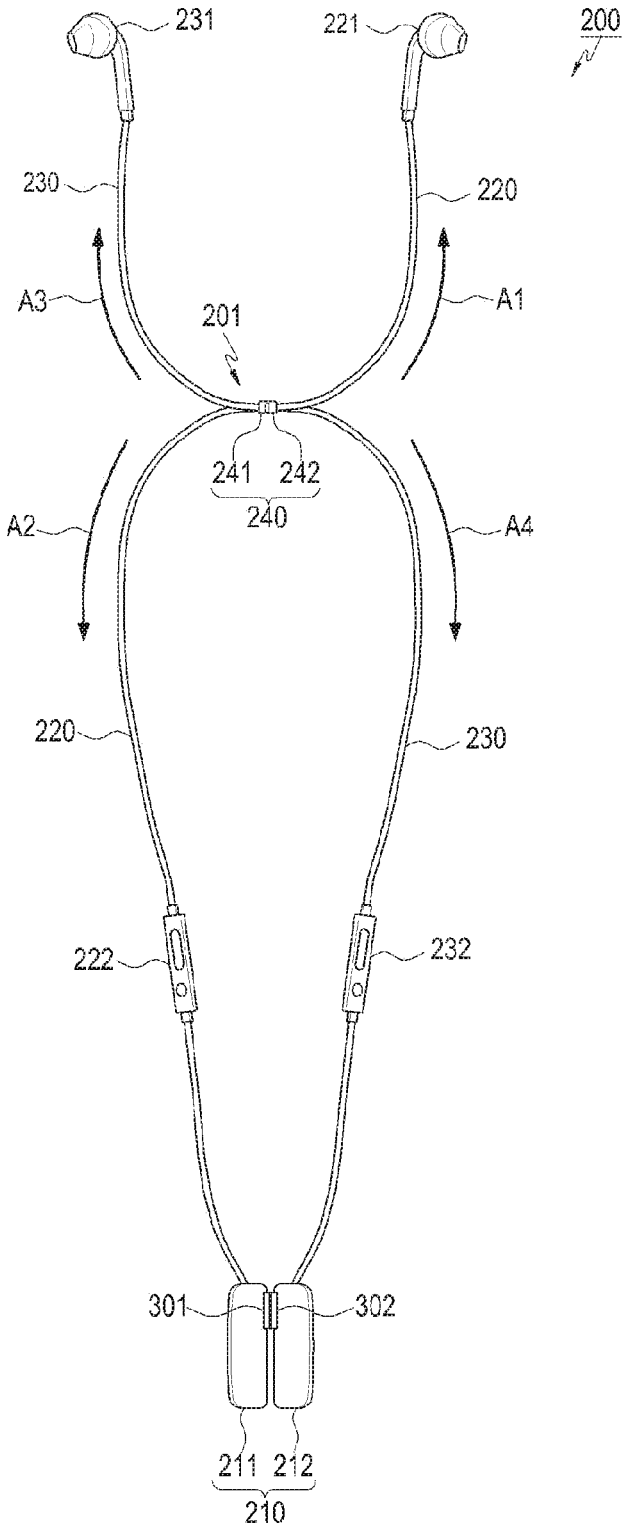

FIGS. 2 and 3 illustrate a configuration of an electronic device, according to an embodiment of the present disclosure;

Referring to FIGS. 2 and 3, an electronic device 200 (e.g., the electronic device 101 of FIG. 1) is formed as a necklace-type wearable electronic device. The electronic device 200 includes a main device, i.e., a housing 210, and a necklace band 201.

The housing 210 is connected to one end of first and second lines 220 and 230 of the necklace band 201, is formed in a pendant form, and includes components for driving the electronic device 200. For example, the housing 210 includes a first component 211, i.e., a first housing, and an external second component 212, i.e., a detachable second housing. The first component 211 and the second component 212 may be coupled to or separated from each other. Further, the first component 211 is connected to the first line 220 of the necklace band 201, and the second component 212 is connected to the second line 230 of the necklace band 201. Magnets 301 and 302 are formed on a first surface 211*b* of the first component 211 and on a first surface 212*a* of the second component 212, respectively. The first component 211 and the second component 212 may be attached to each other using magnetic force between the first magnet 301 and the second magnet 302.

According to an embodiment of the present disclosure, the housing 210 may include a battery and an audio module electrically connected to the battery. The housing 210 may further include a communication module electrically connected to the battery, a display module, at least one of a processor, one or more sensors, and a memory. Further, the housing 210 may include components of another electronic device in addition to the above-disclosed components.

The necklace band 201 is formed to be worn on the neck of a user. The first line 220 of the necklace band 201 is connected to the housing 210 movably, in an A1 direction or an A2 direction, by a member 240. The second line 230 of the necklace band 201 is connected to the housing 210 movably, in an A3 direction or an A4 direction, by the member 240.

The member 240 includes a through-hole having a diameter sufficient to pass both the first and second lines 220 and 230 through. The member 240 includes a first end 241 and a second end 242 and extends from the first end 241 to the second end 242. That is, the first line 220 extends from the housing 210 to sequentially pass through the first end 241, the through-hole, and the second end 242. Further, the second line 230 extends from the housing 210 to sequentially pass through the second end 242, the through-hole, and the first end 241. In other words, the first line 220 is coupled through the through-hole of the member 240, inserted into the first end 241, and discharged through the second end 242, and the second line 230 is coupled through the through-hole of the member 240, inserted into the second end 242, and discharged through the first end 241.

The first speaker 221 is connected to an end of the first line 220, which extends through the second end 242, and a second speaker 231 can be connected to an end of the second line 230, which extends from the first end 241. The first speaker 221 and the second speaker 231 may be included in an earphone structure to be inserted into the ears of a user.

A first solid structure 222 can be provided at a part of the first fine 220 between the member 240 and the housing 210. A second solid structure 232 can be provided at a part of the second line 230 between the member 240 and the housing 210. The first structure 222 and the second structure 232 can be formed to have a size and/or shape which cannot pass through the through-hole. The first structure 222 or the second structure 232 may include at least one of a microphone, a volume adjustment key, a speaker, or a power button. In other words, the first and second structures 222 and 232 can be configured by a housing or case which can embed the above-disclosed components therein.

The first line 220 and the second line 230 include a conductive line extending from the housing 210 and a nonconductive material coating the conductive line. That is, the first line 220 and the second line 230 are configured by a wire line in which an electric wire is embedded to electrically connect the housing 210 of the electronic device 200 and the first and second speakers 221 and 231 to each other.

Figure 4:
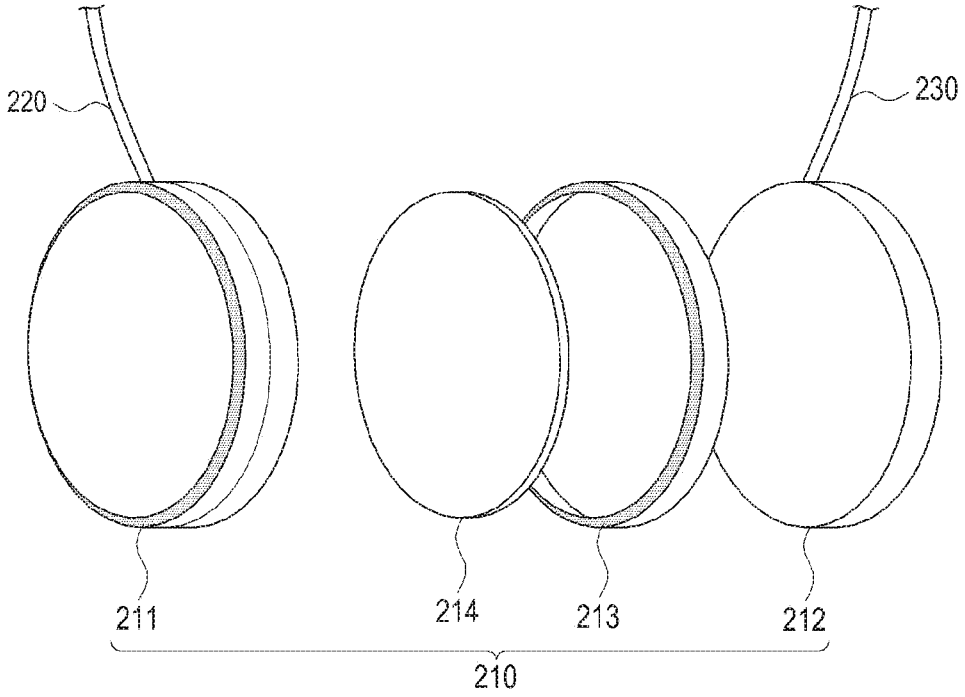
FIG. 4 illustrates a configuration of a housing of an electronic device, according to an embodiment of the present disclosure.

FIG. 4 illustrates a configuration of a housing of an electronic device, according to an embodiment of the present disclosure.

Referring to FIG. 4, the housing 210 can be configured such that a third component 213 and a display 214 are disposed between the first component 211 and the second component 212. The third component 213 is attached to a surface separated from the first component 211 and the second component 212. The display 214 is entered into the first component 211.

Figure 5:
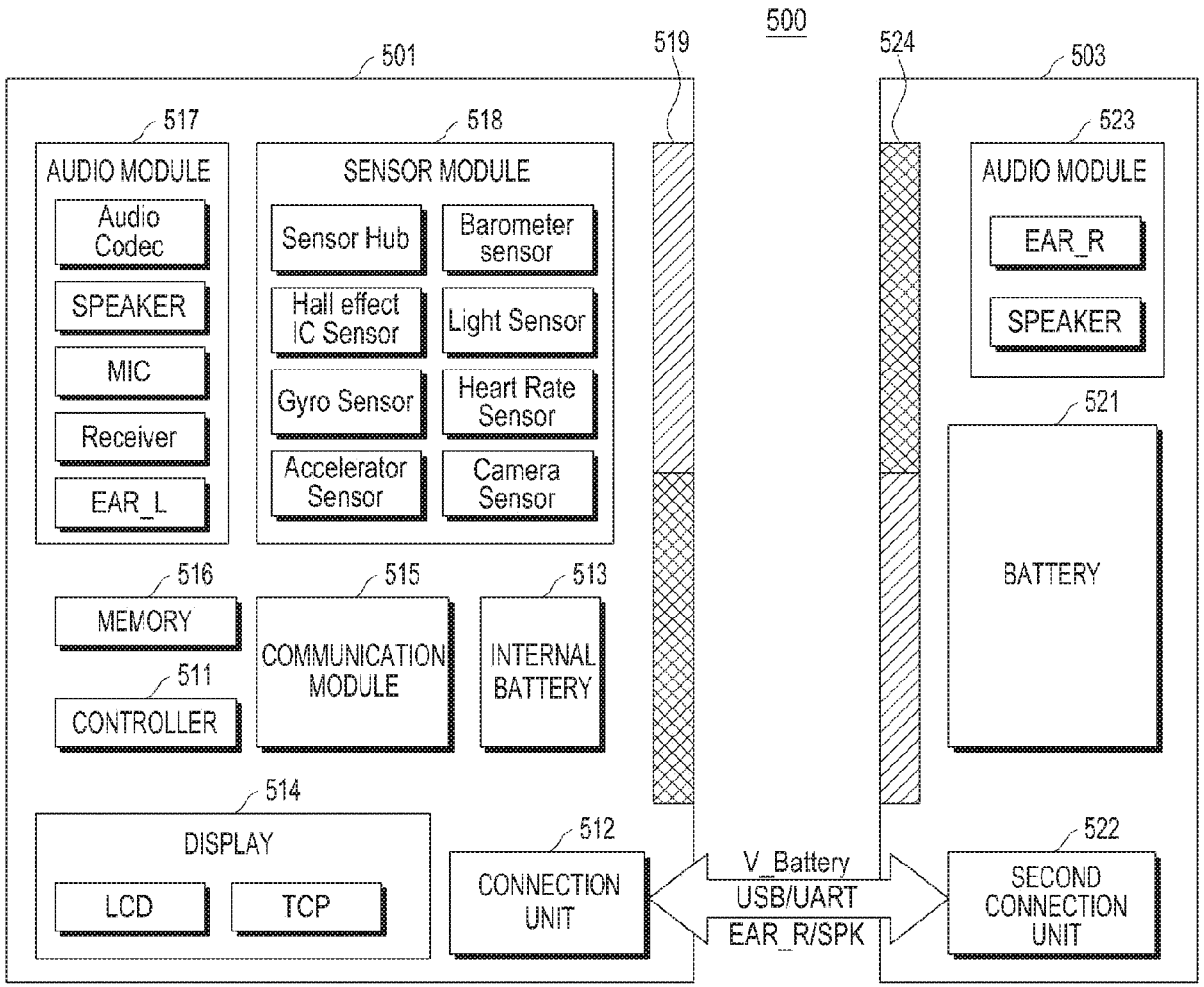
FIG. 5 is a block diagram of a configuration of an electronic device, according to an embodiment of the present disclosure.

FIG. 5 is a block diagram of a configuration of an electronic device, according to an embodiment of the present disclosure.

Referring to FIG. 5, an electronic device 500 (e.g., the electronic device 101 of FIG. 1) includes at least one of a first component 501 (e.g., the first component 211 of FIGS. 2 to 4) and at least one external component, i.e., a second component 503 (e.g., at least one of the second component 212 or the third component 213 of FIGS. 2 to 4).

The first component 501 includes at least one of a controller 511, a first connection unit 512, an internal battery 513, a display 514 (e.g., the display 214), a communication module 515, a memory 516, a first audio module 517, and a sensor module 518. A first coupling part 519, including magnets (e.g., the magnets 301 and 302 of FIG. 3), can be formed on one surface of a housing of the first component 501. Further, the first component 501 may further include an input unit (not illustrated). In some embodiments, the first component 501 of the electronic device 500 may omit at least one of the components or may additionally include another component.

The second component 503 includes a battery 521, a second connection unit 522, a second audio module 523, and a second coupling part 524, including a magnet, can be formed on one surface of a housing thereof to which the first component 501 is attached. In some embodiments, the second component 503 of the electronic device 500 may omit at least one of the components or may additionally include another component.

The first component 501 can be coupled to the second component 503 through the first coupling part 519 formed on an first surface of the housing of the first component 501 and a second coupling part 524 formed on an first surface of the housing of the second component 503. Further, when the first component 501 is coupled to the second component 503, the first connection units 12 located on the first surface of the housing of the first component 501 is electrically connected to the second connection unit 522 located on the first surface of the housing of the second component 503.

Further, according to an embodiment of the present disclosure, the electronic device 500 may further include at least one other detachable external component (e.g., a third component 213 of FIG. 4) which can be coupled to or separated from the first component 501 and/or the second component 503. The least one other detachable external component may be located between the first component 501 and the second component 503.

The at least one other detachable external component that is the third component can be connected wirelessly or by wire to an external power supply device (e.g., a charging device) and an external data communication device (e.g., a USB), and can provide external power applied from the external power supply device, to at least one of the first component 501 and the second component 503. A housing (e.g., one surface or both surfaces of the housing) of the third component may include a coupling part including at least one magnet and a battery for supplying power to at least one of the first component 501 and the second component 503. Further, a third magnet located on a first surface of the housing of the third component can be coupled to the first magnet 505*a* of the first coupling part 519 located on the first surface of the housing of the first component 501, and a fourth magnet located on a second surface of the housing of the third component can be coupled to the second magnet 505*b* of the second coupling part 524 located on the first surface of the housing of the second component 503. Further, a third connection unit located on the first surface of the housing of the third component can be electrically connected to the first connection unit 512 located on the first surface of the housing of the first component 501, and a fourth connection unit located on the second surface of the housing of the third component can be electrically connected to the second connection unit 522 located on the first surface of the housing of the second component 503.

According to an embodiment of the present disclosure, the controller 511 (e.g., the processor 120 of FIG. 1) processes information according to an operation of the electronic device 500 and information according to the execution of an application or a function, and controls to display the information according to the execution of an application on the display 514 or outputs the same through the first audio module 517.

The controller 511 makes a control to charge the internal battery 513 by power supplied from an external source through the first connection unit 512. That is, when the second component 503 is attached to the first component 501, the controller 511 controls to receive external power from the second component 503 to operate the first component 501 and charge the internal battery 513 using the received external power. Further, when the second component 503 is attached to the first component 501, the controller 511 controls to interrupt the power supplied from the internal battery 513. Further, since the supply from external power is interrupted when the second component 503 is detached from the first component 501, the controller 511 controls to receive power from the internal battery 513, when detached, in order to maintain a function of the electronic device 500 being executed.

The controller 511 controls the first audio module 517 to transmit an audio signal output from the first audio module 517 to the necklace band (i.e., the necklace band 201 of FIGS. 2 and 3). The audio signal can be transmitted to a first external speaker (i.e., the first speaker 221 of FIGS. 2 and 3) of an earphone through a first line (e.g., the first line 220 of FIG. 2) electrically connected to the first audio module 517 of the first component 501 and/or a second external speaker (i.e., the first speaker 231 of FIGS. 2 and 3) of the earphone through a second line (e.g., the second line 230 of FIG. 2) electrically connected to the second audio module 523 of the second component 503.

When the third detachable component is attached to the first component 501, the controller 511 can determine whether the second component 503 is attached to the third component. When the third component is attached to the second component 503, the controller 511 makes a control to receive power from the battery 521 of the second component 503, which is charged by power provided from the third component. When power is supplied from the third component, the controller 511 controls to interrupt power provided from the internal battery 513. Further, when the third component is not attached to the second component 503, the controller 511 controls to receive external power from the battery included in the third component or the power supply device connected to the third component.

The controller 511 can identify a connection state of the second line of the necklace band electrically connected to the second component 503, and determine whether the second component 503 is attached or detached on the basis of a result of identifying the connection state of the second line. Further, the controller 511 can determine whether the second component 503 is attached or detached on the basis of a resistance value identified according to a forward voltage (VF) of the first connection unit 512.

When the third component is attached to the first component 501, the controller 511 controls data communication with an external device through the third component. The controller 511 can, for example, controls to transmit/receive data by electrically connecting a connection pin for data transmission/reception of the first connection unit 512 and a connection pin for data transmission/reception of the connection unit located on the first surface of the third component.

Further, the controller 511 of the electronic device 500 may be at least a part of a processor, and may include a combination of one or more of hardware, software and firmware.

Further, a configuration of at least a part of the controller 511 of the electronic device may include, in hardware, at least one processor including a Central Processing Unit (CPU)/Micro Processing Unit (MPU), a memory (e.g., a register and/or a Random Access Memory (RAM)) to which at least one piece of memory loading data is loaded, and a part of buses through which at least one piece of data is input/output from/to the processor and the memory. Further, the controller 511 may include, in software, a predetermined program routine or program data which is loaded from a predetermined recording medium to the memory and is processed by the processor in order to perform a function defined in the electronic device.

According to an embodiment of the present disclosure, the first connection unit 512 (e.g., the input/output interface 150 of FIG. 1) of the first component 501 which is a connection terminal electrically connected to the second connection unit 522 of the second component 503, can be configured by a pogo pin.

According to an embodiment of the present disclosure, the display 514 (e.g., the display 160 of FIG. 1) of the electronic device 500 displays information on a result of executing an operation according to a control of the controller 511. Further, the display 514 displays various pieces of information (e.g., at least one of a text, an image, a video and a sound) for a user. Further, the display 514 displays, on a screen, using various schemes, an input window or an input pad (e.g., a button) which can input, to the input window, at least one of various characters, numbers, and symbols. Further, the display 514 displays a service execution screen according to execution of various applications related to information transmission/reception.

Further, when the display 514 of the electronic device is implemented in a form of a touch screen, the input apparatus and/or the display 514 may correspond to the touch screen. When being implemented in a form of a touch screen together with the input apparatus, the display 514 displays various pieces of information generated according to a touch operation of a user.

Further, the display 514 of the electronic device may be configured by one or more of a LCD, a Thin Film Transistor LCD (TFT-LCD), air OLED, an LED, an Active Matrix Organic LED (AMOLED), a flexible display, and a three dimensional display. Further, some of the displays may be implemented as a transparent type or a light transmission type, such that the outside can be seen therethrough. These displays can be configured in a form of a transparent display, including a Transparent OLED (TOLED).

According to an embodiment of the present disclosure, the communication module 515 (e.g., the communication interface 170 of FIG. 1) of the electronic device 500 communicates with another electronic device or an external device according to the control of the controller 511. The communication module 515 transmits/receives data relating to an executed operation to/from the external device according to the control of the controller 511. The communication module 515 performs communication through a connection to a network or a connection between devices through wired communication or wireless communication through a communication interface. The wireless communication may include at least one of Wi-Fi, Bluetooth (BT), Near Field Communication (NFC), Global Positioning System (GPS) and cellular communication (e.g., LTE, LTE-A, CDMA, WCDMA, UMTS, WiBro, GSM, etc,). The wired communication includes at least one of for example, a Universal Serial Bus (USB), a High Definition Multimedia Interface (HDMI), Recommended Standard 232 (RS-232), and a Plain Old Telephone Service (POTS). Further, the communication module 515 may include all types of communication schemes, which are widely known or will be developed later, in addition to the above-described communication schemes.

According to an embodiment of the present disclosure, the memory 516 (e.g., the memory 130 of FIG. 1) of the electronic device 500 temporarily stores various pieces of data generated during the execution of a program necessary for operating a function, as well as the program. The memory 516 may broadly include a program area and a data area. The program area stores information related to operating the electronic device 500, such as an Operating System (OS) for booting the electronic device 500. The data area stores transmitted, received, and generated data. Further, the memory 516 may include at least one storage medium of a flash memory, a hard disc, a multimedia card micro type memory (e.g., an SD memory or an XD memory), a RAM and a ROM.

According to an embodiment of the present disclosure, the first audio module 517 (e.g., the input/output interface 150 of FIG. 1) of the electronic device 500 may include at least one of an audio CODEC, a microphone, a receiver, and an output unit (e.g., a first output unit) including an earphone output EAR_L or a speaker. The first audio module 517 may omit at least some of the components or may further include another component for processing an audio signal in addition to the components.

According to an embodiment, the first output unit of the first audio module 517 is connected to the first line of the necklace band, and outputs an audio signal of an executed function according to the control of the controller 511. The first output unit of the first audio module 517 is connected to the first line of the necklace hand, and transfers the output audio signal to the connection first line. Further, the first output unit of the first audio module 517 is connected to the second component 503 through the first connection unit 512, and transfers an audio signal to the second audio module 523 of the second component 503.

According to an embodiment of the present disclosure, the audio module 523 includes an output unit (e.g., a second output unit) including an earphone output EAR_R or a speaker, and is connected to the second line of the necklace band, and outputs the received audio signal to the second line.

According to an embodiment of the present disclosure, the sensor module 518 (e.g., the input/output interlace 150 of FIG. 1) of the electronic device 500 includes a sensor huh or various sensors (e.g., at least one of a barometer sensor, a hall effect IC sensor, a light sensor, a gyro sensor, a heart rate sensor, an accelerator sensor, and a camera sensor).

According to an embodiment of the present disclosure, the electronic device 500 may additionally include an input apparatus. The input apparatus (e.g., the input/output interface 150 of FIG. 1) transfers, to the controller 511, a signal input with regard to various pieces of information, a setting of various functions, and a function control of the electronic device 500. Further, the input apparatus supports a user input for executing an application supporting a specific function of the electronic device 500. The input apparatus may include at least one of a key input means such as a keyboard or a keypad, a touch input means such as a touch sensor or a touch pad, a sound source input means, various sensors and a camera, and may include a gesture input means. In addition, the input apparatus may include all types of input means which are being developed currently or can be developed later. Further, the input apparatus can receive, from a user, information input by the user through a touch panel of the display 514 or a camera module, and can transfer the input information to the controller 511.

According to an embodiment of the present disclosure, the first coupling part 519 of the first component 501 and the second coupling part 524 of the second component 503 are located on the surfaces of the respective housings and include at least one magnet, respectively.

FIGS. 6 to 11C illustrate various configurations of a coupling part located in a housing of an electronic device, according to an embodiment of the present disclosure.

Figure 6:
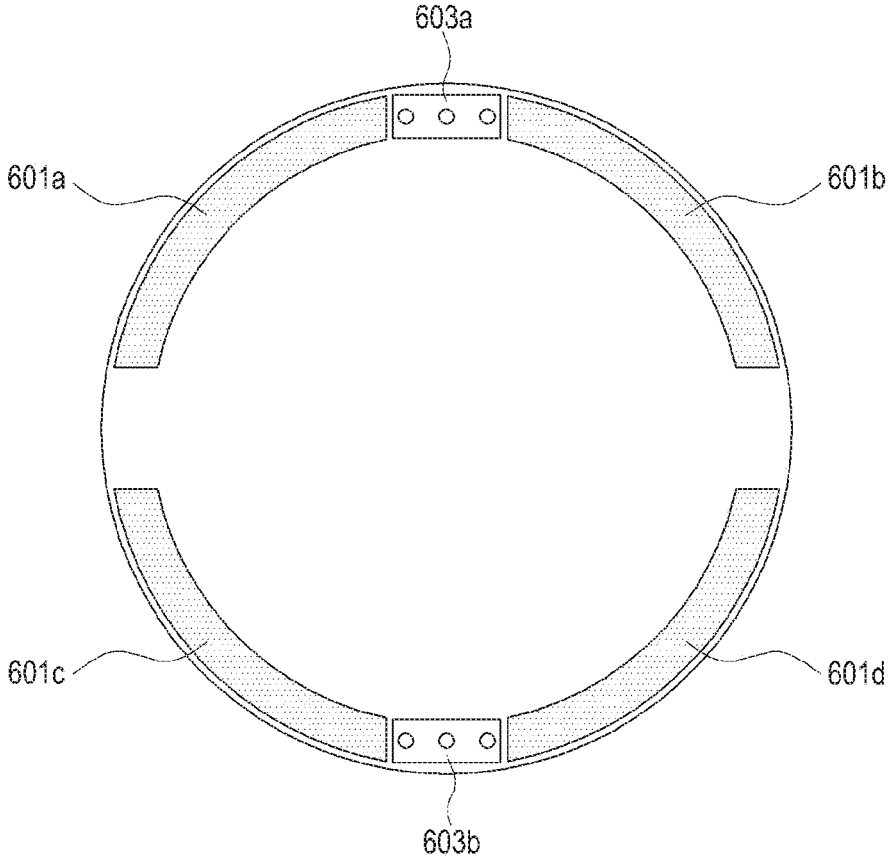
FIGS. 6, 7, 8, 9, 10, 11A, 11B, and 11C illustrate various configurations of a coupling part located in a housing of an electronic device, according to an embodiment of the present disclosure.

Referring to FIG. 6, the first coupling part 519 of the first component 501 and the second coupling part 524 of the second component 503 of FIG. 5 may arrange at least one magnet 601*a*, 601*b*, 601*c* or 601*d* and at least one connector of the connection unit, i.e., connection pins 603*a* and 603*b* on the surfaces (e.g., the first surface 2111 of the first component 211 and the first surface 212*a* of the second component 212) of the housings.

Figure 7:
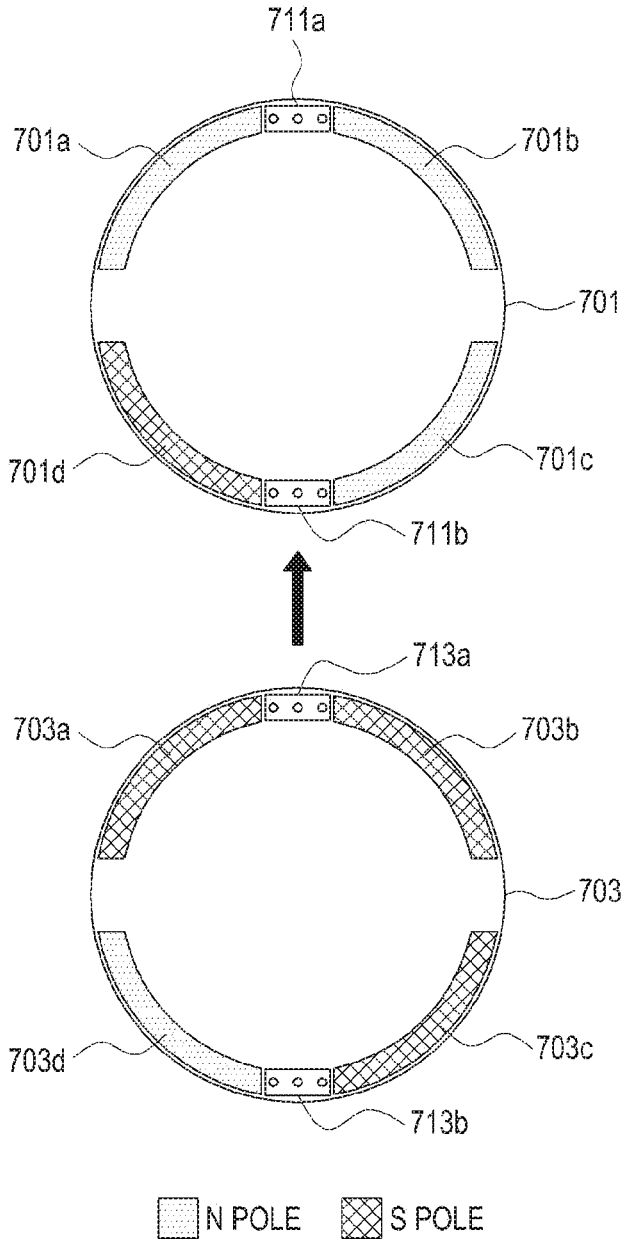

Referring to FIG. 7, a first component 701 and a second component 703 are shown. The first component 701 has at least one magnet 701*a* and 701*b*, corresponding to an N pole, arranged on at least one area of the component 701 adjacent to a connection pin 711*a*. The first component 701 additionally has at least one magnet 701*c*, corresponding to an N pole, and at least one magnet 701*d*, corresponding to an S pole, arranged on another area of the component 701 adjacent to as connection pin 711*b*.

The second component 703 has at least one magnet 703*a* and 703*b*, corresponding to an S pole, arranged on at least one area of the second component 703 configured adjacent to as connection pin 713*a*. The second component 703 additionally has at least one magnet 703*c*, corresponding to an S pole, and at least one magnet 703*d*, corresponding to an N pole, arranged on another area of the component 703 adjacent to a connection pin 713*b*. As illustrated in FIG. 7, the magnets 701*a*, 701*b*, 701*c* and 701*d* arranged in the first component 701 and the magnets 703*a*, 703*b*, 703*c* and 703*d* arranged in the second component are arranged such that opposite poles thereof face each other, wherein an S pole of at least one of the magnets 701*a*, 701*b*, 701*c* and 701*d* is arranged to face the front side, N poles of the others thereof are arranged to face the front side, an N pole of at least one of the magnets 703*a*, 703*b*, 703*c* and 703*d* is arranged to the front side, and S poles of the others thereof are arranged to face the front side.

Figure 8:
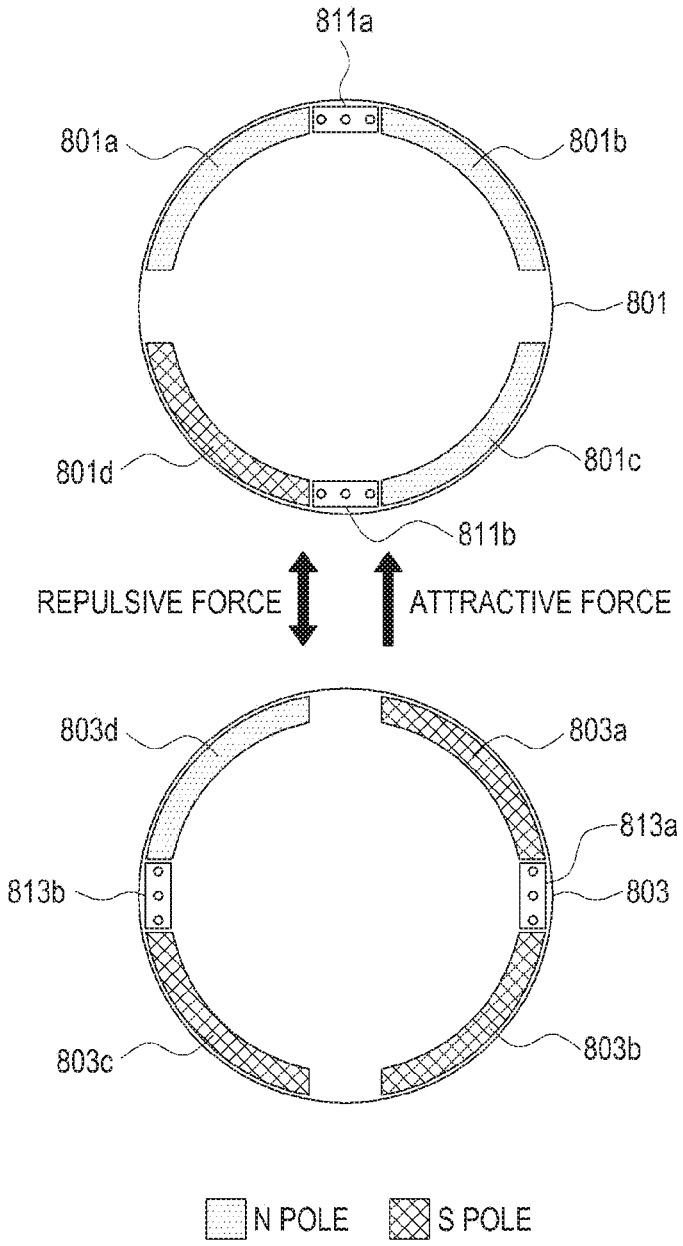

Referring to FIG. 8, according to an embodiment, a first component 801 and a second component 803 configured identically to those in FIG. 7 are shown. In the first component 801 and the second component 803, an attractive force or repellant force may occur between magnets 801*a*, 801*b*, 801*c* and 801*d* arranged in the first component 801 and magnets 803*a*, 803*b*, 803*c* and 80*d* arranged in the second component 803, respectively. Accordingly, forward guiding force occurs in connection pins 811*a* and 811*b* of as connection unit of the first component 801 and connection pins 813*a* and 813*b* of as connection unit of the second component 803, and the first component 801 and the second component 803 can be electrically connected to each other by the force.

Figure 9:
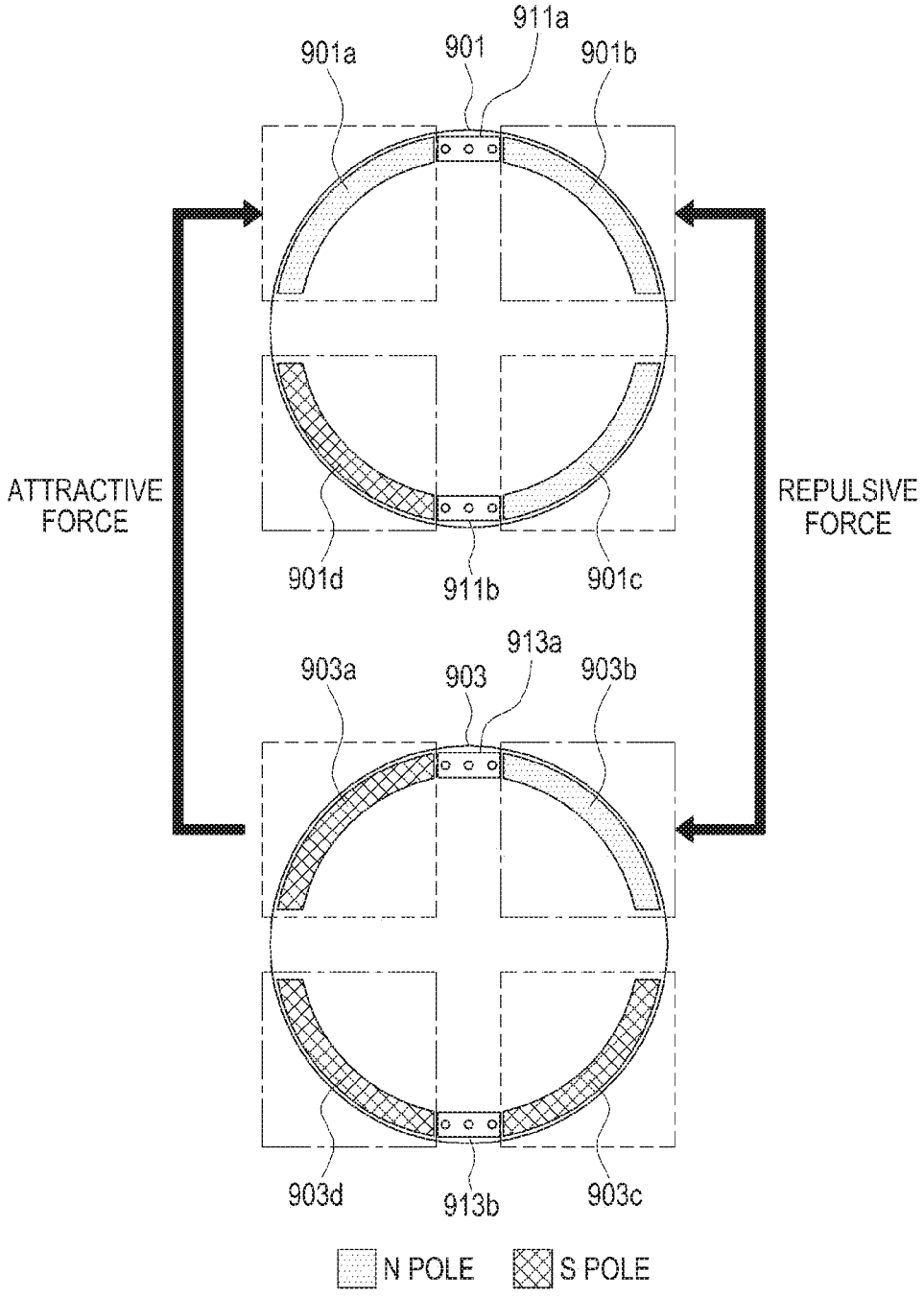

Referring to FIG. 9, a first component 901 and second component 903 are shown. An attractive force or repellant force occurs by opposite polarities (N pole or S pole) of magnets 901*a*, 901*b*, 901*c* and 901*d* arranged in the first component 901 and magnets 903*a*, 903*b*, 903*c*, and 903*d* arranged in the second component 903, so that forward guiding force occurs. Further, connection pins 911*a* and 911*b* of the first component 901 and connection pins 913*a* and 913*b* of the second component 903 can be electrically connected to each other by the occurred force.

Figure 10:
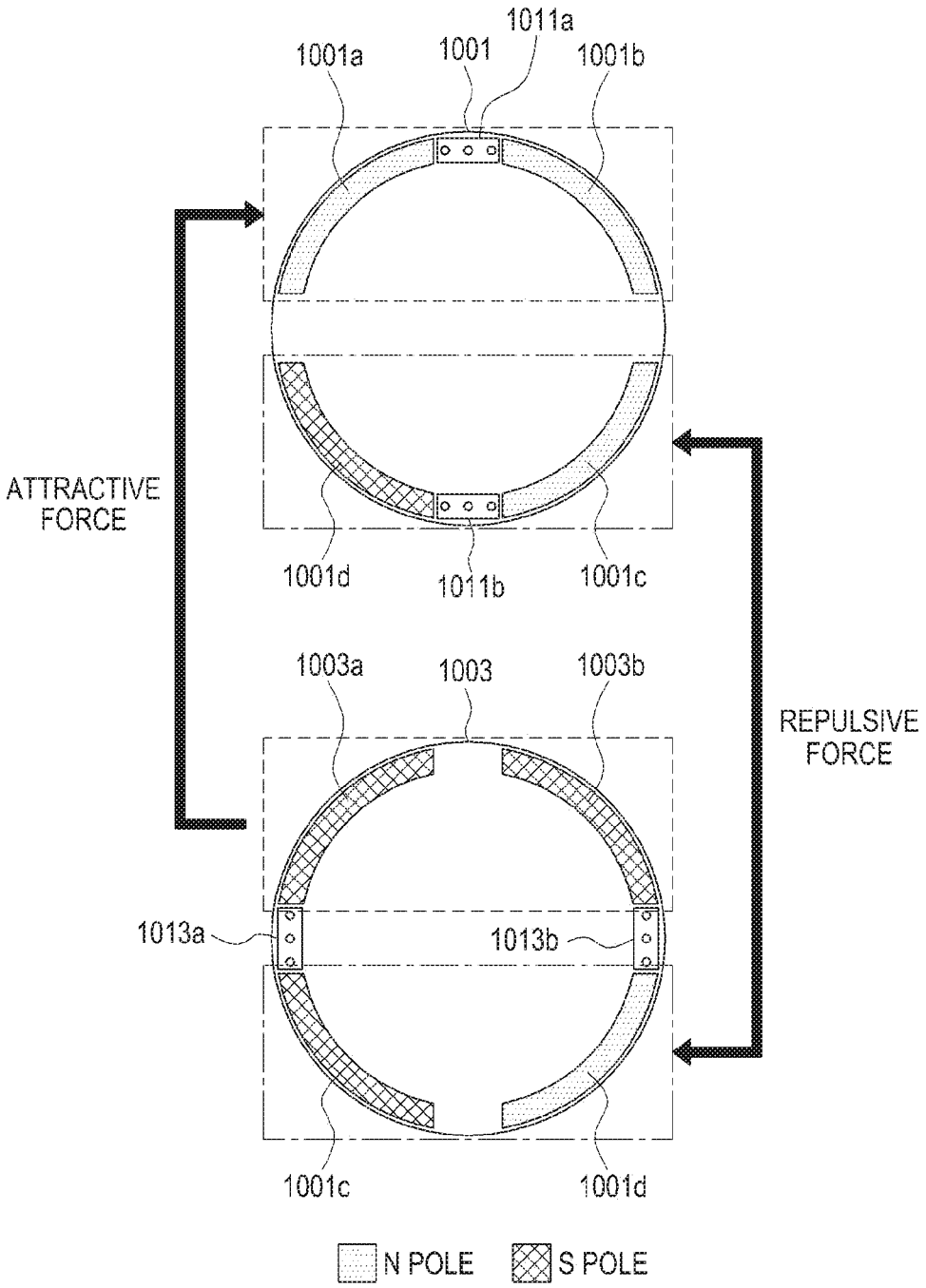

Referring to FIG. 10, a first component 1001 and second component 1003 are shown. An attractive force or repellant force occurs by opposite polarities (N pole or S pole) of magnets 1001*a*, 1001 *b*, 1001*c* and 1001*d* arranged in a first component 1001 and magnets. 1003*a*, 1003*b*, 1003*c*, and 1003*d* arranged in a second component 1001, so that forward guiding force occurs. Further, connection pins 1011.*a* and 1011*b* of the first component 1001 and connection pins 1013*a* and 1013*b* of the second component 1001 can be electrically connected to each other by the force.

Figures 11A, 11B, 11C:
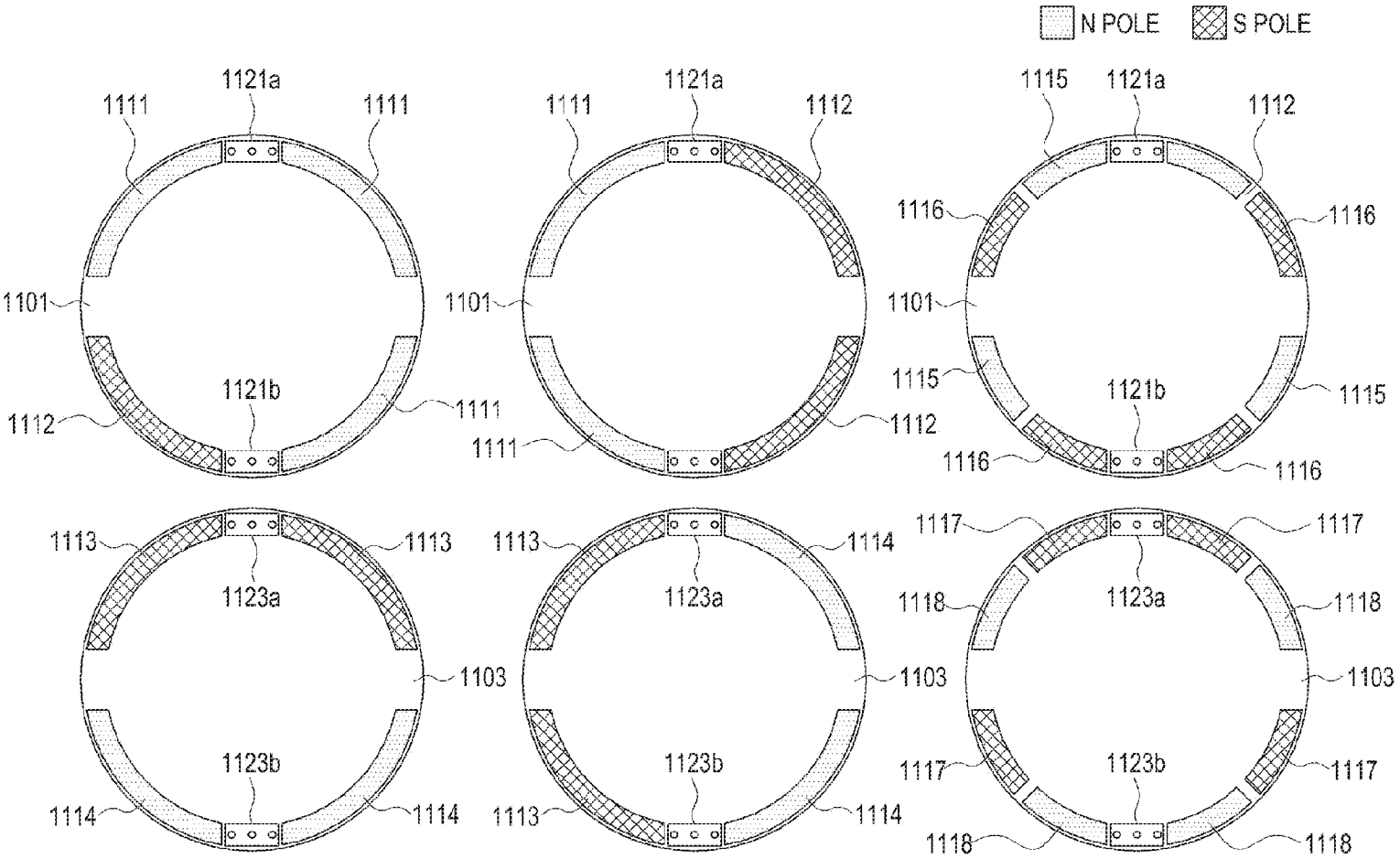

Referring to FIGS. 11A to 11C, a first component 1101 and second component 1103 are shown having various magnet configurations, in the first component 1101 and the second component 1103, arrangement of magnets having opposite polarities (N pole or S pole) can be variously changed.

Referring to FIG. 11A, in connection with an arrangement of the first magnets 1111 and 1112 and the second magnets 1113 and 1114, on an surface (e.g., the first surface 211*b* of the first component 211 of FIG. 2) of the first component 1101, the N pole magnets 1111 can be arranged in areas (e.g., left and right areas)) configured with reference to an upper connection pin 1121*a* of the first connection unit, the S pole magnet 1112 and the N pole magnet 1111 can be arranged in areas (e.g., left and right areas) configured with reference to a lower connection pin 1121*b*. Further, on one surface of the second component 1103 (e.g., the first surface 212*a* of the second component 212 of FIG. 2), the S pole magnets 1113s can be arranged in areas (e.g., left and right areas) configured with reference to an upper connection pin 1123*a* of the second connection unit and the N pole magnets 1114 can be arranged in areas (e.g., left and right areas) configured with reference to a lower connection pin 1123*b*.

Further, according to an embodiment, when an the third component is coupled between the first component 1101 and the second component 1103, magnets having polarities opposite to those of magnets arranged in the first component may be arranged on the first surface of the third component, and magnets having polarities opposite to those of magnets arranged in the second components may be arranged on the second surface of the external component.

Referring to FIG. 11B, the first magnets 1111 and 1112 may be arranged to have different polarities with reference to the connection pins 1121*a* and 1121*b*, and in contrast, the second magnets 1113 and 1114 may be arranged to have different polarities with reference to the connection pins 1123*a* and 1123*b*.

Referring to FIG. 11C, the first component 1101 may have two or more magnets 1115 and 1116 arranged in different polarities on left and right sides with reference to the connection pins 1121*a* and 1121*b*. In contrast, the second component 1103 may have two or more magnets 1117 and 1118 arranged in different polarities on left and right sides with reference to the connection pins 1123*a* and 1123*b*.

The main components electronic device 500 of FIG. 5 have been described above. However, not all the components illustrated in FIG. 5 are necessary components. Further, the electronic device 500 may be implemented by more components than the illustrated components or the electronic device 500 may be implemented by fewer components than the illustrated components. Further, the locations of the main components of the electronic device 500 may be changed according to an embodiment of the present disclosure.

An electronic device according to one of an embodiment of the present disclosure includes a necklace band; and a first component connected to the necklace band, wherein the first component includes a first magnet located on one surface of a housing of the first component, a first connection unit located on one surface of the first component and is electrically connected to a second connection unit located on one surface of the second component; and a controller configured to connect the first connection unit and the second connection unit when the first magnet is attached to a second magnet located on a first surface of the second component, and receive power from the second component through the first connection unit connected with the second connection unit.

According to an embodiment of the present disclosure, the first component may further include an internal battery which is charged by the received power, and supplies power for operating the electronic device when the second component is detached from the first component.

According to an embodiment of the present disclosure, the first component may further include an audio module for transmitting an audio signal to the necklace band.

According to an embodiment of the present disclosure, the audio module includes a first output unit for the audio signal to a first external speaker of the necklace band while being connected to a first line of the necklace band. Wherein the first output unit is connected to a first line of the necklace band, and transmits the audio signal to the second component including a second output unit, and wherein the second output unit is connected to a second line of the necklace band, and outputs the audio signal to a second external speaker of the necklace band.

According to an embodiment of the present disclosure, the electronic device further comprises the second component connected to the necklace band; and a third component configured to supply power to at least one of the first component and the second component. Wherein the third component is located between the first component and the second component, electrically connects a third connection unit located on a first surface of the third component to the first connection unit of the first component, when a third magnet located on the first surface of the third component is attached to the first magnet, and electrically connects a fourth connection unit located on a second surface of the third component to the second connection unit of the second component, when a fourth magnet located on the second surface of the third component is attached to the second magnet.

According to an embodiment of the present disclosure, the controller controls to be electrically connected to the third component when the one surface of the housing of the detachable third component is attached to the one surface of the housing of the first component, and controls to receive power a battery of the second component charged by the power supplied from the third component.

According to an embodiment of the present disclosure, the controller controls to receive power from the third component, when a first surface of the third component is attached by the first magnet to the first surface of the first component and a second surface of the third component is not attached to the first surface of the second component.

According to an embodiment of the present disclosure, when the third component is attached to the first component, the controller electrically connects a first connection pin for transmitting/receiving data of the first connection unit and a third connection pin for transmitting/receiving data of the third connection unit located on the first surface of the third component, so as to transmit/receive data to/from an external device through the third component.

According to an embodiment of the present disclosure, the controller determines whether the second component is attached to the first component based on a connection state of the second line of the necklace hand.

According to an embodiment, the controller determines whether the second component is attached to the first component based on identifies a resistance value identified according to as voltage applied to a connection pin with regard to a forward voltage of the first connection unit.

Figure 12:
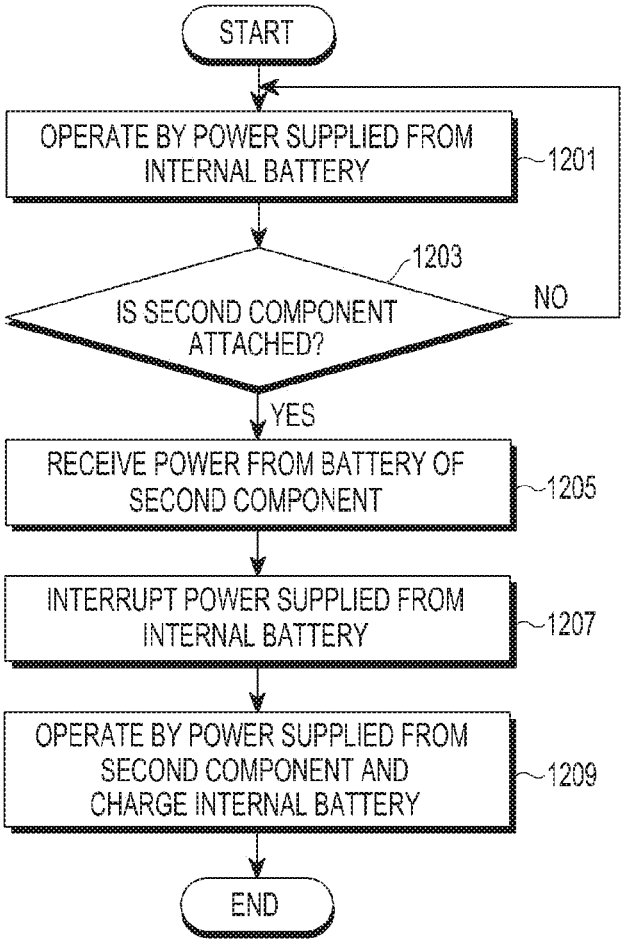
FIG. 12 is a flowchart of a procedure of operating an electronic device, according to an embodiment of the present disclosure.
Figure 13:
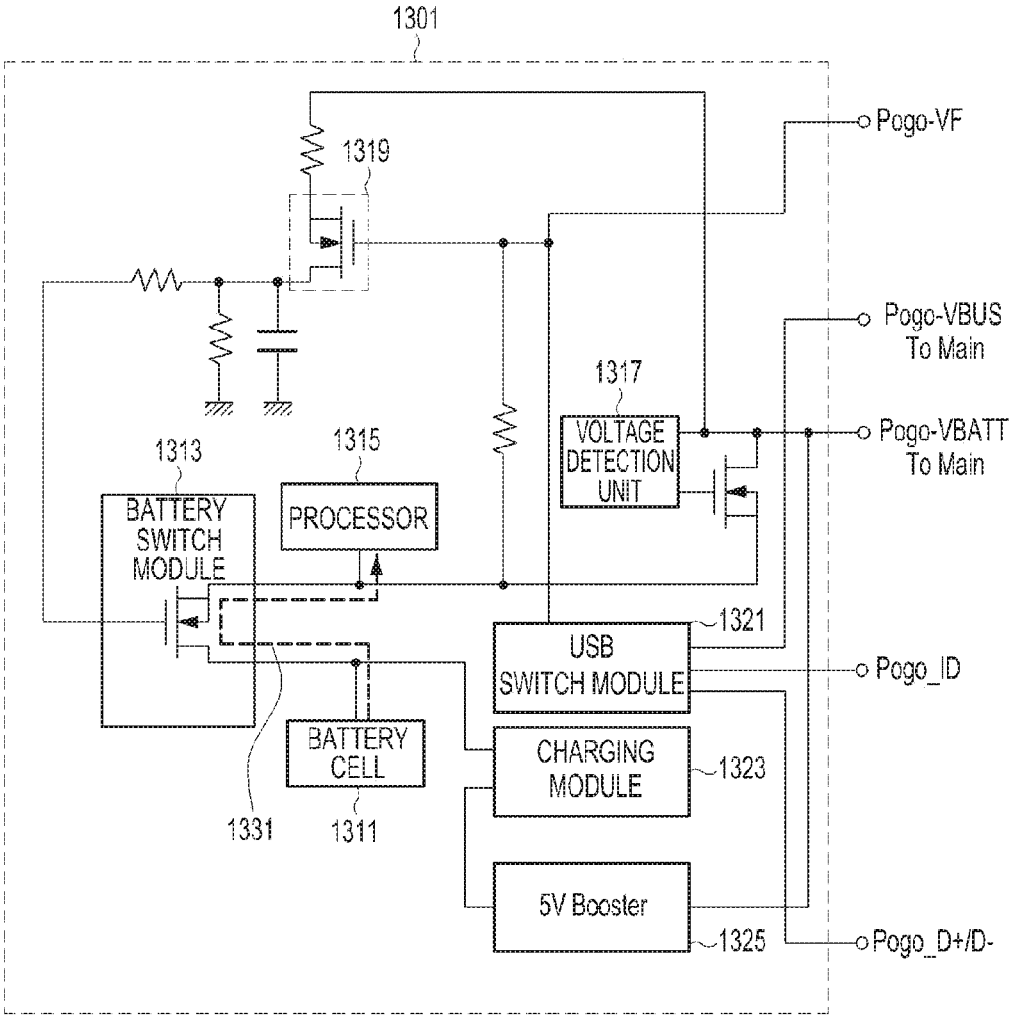
FIGS. 13 and 14 illustrate configurations of a circuit of an electronic device, according to various embodiments of the present disclosure.
Figure 14:
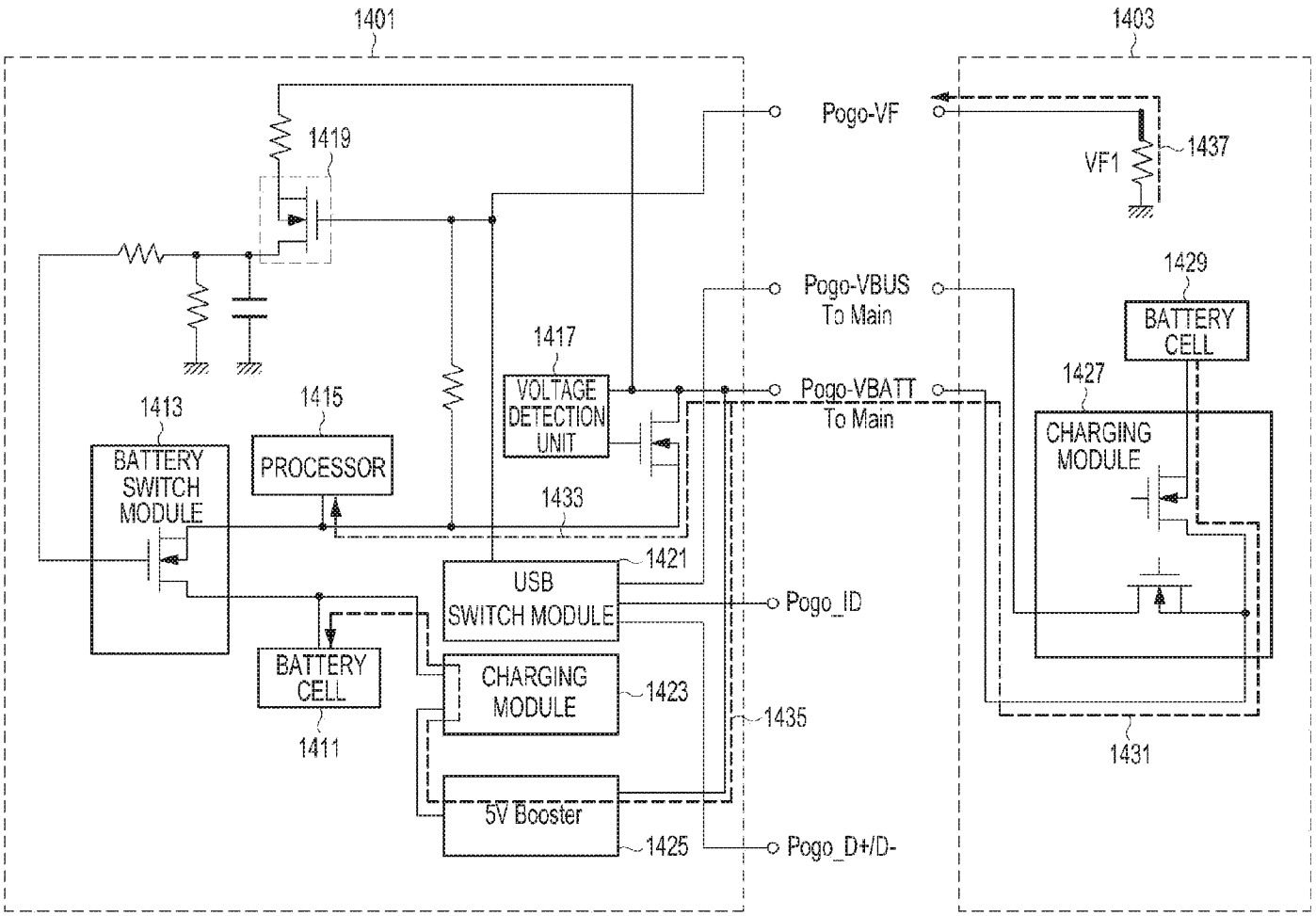

FIG. 12 is a flowchart of a procedure of operating an electronic device, according to an embodiment of the present disclosure. FIGS. 13 and 14 are configurations of a circuit an electronic device, according to various embodiments of the present disclosure.

Referring to FIG. 12, in step 1201, a first component (e.g., the first component 501 of FIG. 5) of an electronic device (e.g., the electronic device 101 of FIG. 1) can operate the electronic device by power supplied from an internal battery.

Referring to FIG. 13, according to one embodiment of the present disclosure, the first component 1301 includes at least one of a battery cell 1311 (e.g., the internal battery 513 of FIG. 5) corresponding to an internal battery, a battery switch module 1313, a processor 1315 (e.g., the processor 120 of FIG. 1 or the controller 511 of FIG. 5), a voltage detection unit 1317, a USB switch module 1321, a charging module 1323 and a booster 1325 (e.g., a 5V booster). Further, the first component 1301 includes at least one of a plurality of resistors, a plurality of transistors (e.g., a Field Effect Transistor (FET)) and at least one capacitor. In the first component 1301, when a second component (e.g., the second component 503 of FIG. 5) or a third component) is separated therefrom, the processor 1315 can be operated by power 1331 (e.g., operating power) supplied from the battery cell 1311. The battery switch module 1313 includes a first transistor for interrupting or applying the power 1331 (e.g., the operating power) applied from the battery cell 1311 according to whether the second component or the third component is attached or detached, and terminals of the included first transistor can be connected to the battery cell 1311, a second transistor 1319 and a main processor 1315, respectively. The battery cell 1311 is connected to a charging module 1323 connected to the booster 1325 for receiving power through the battery switch module 1313 and a connection pin (POGO_V_BATT pin) of a connection unit (e.g., the first connection unit 512 of FIG. 5). Terminals of the second transistor 1319 are connected to the battery switch module 1313, the USB switch module 1321, and the power detection unit 1317, respectively. The main processor 1315 is connected to the battery switch module 1313, the voltage detection unit 1317, and the second transistor 1319. The USB switch module 1321 is connected to pins (e.g., a POGO_VF pin, a POGO_VBUS pin, a POGO_ID pin and a POGO_D+/D− pin) of the connection unit. The voltage detection unit 1317 is connected to the battery switch module 1313, the processor 1315, and the second transistor 1319 through a third transistor, and receives external power through a POGO_V_BATT pin while being connected to the connection unit.

Referring back to FIG. 12, in step 1203, the first component can determine whether the second component is attached. According to an embodiment of the present disclosure, the first component can determine whether the second component is coupled, by identifying a connection state of the second line of the necklace band. For example, it can be identified that the first component and the second component are separated from each other, by identifying that a connection between the first connection unit and the second connection unit is interrupted in a path through which the audio signal is transmitted, according to a transmission failure of the audio signal to be transmitted to the second line.

Referring to FIG. 13, according to another embodiment of the present disclosure, the first component 1301 can determine whether the second component is separated therefrom, by determining, by the voltage detection unit 1317, whether external power is supplied through the POGO_V_BATT pin of the connection unit. That is, the first component 1301 can determine whether the second component is coupled thereto or separated therefrom, on the basis of a resistance value according to a forward voltage VF of the connection pin (e.g., a POGO_VF pin) of the first connection unit (e.g., the first connection unit 512 of FIG. 5).

Referring back to FIG. 12, when it is identified in step 1203 that the second component is separated from the first component, the first component performs step 1201 again, and when it is identified in step 1203 that the second component is attached to the first component, the first component performs step 1205.

In step 1205, the first component can receive power from a battery of the second component through an electrical connection between the first connection unit and the second connection unit (e.g., the second connection unit 522 of FIG. 5).

Referring to FIG. 14, according to another embodiment of the present disclosure, a first component 1401 (e.g., the first component 501 of FIG. 5) and a second component 1403 (e.g., the first component 503 of FIG. 5) are shown. The first component 1401 is electrically connected to a first connection unit (e.g., the first connection unit 512 of FIG. 5) and a second connection unit (e.g., the second connection unit 522 of FIG. 5), and receives power from a battery cell 1429 (e.g., the battery 521 of FIG. 5) of a second component 1403 (e.g., the second component 503 of FIG. 5). The first component 1401 includes at least one of a battery cell 1411 (e.g., the internal battery 513 of FIG. 5) corresponding to an internal battery, a battery switch module 1413, a processor 1415 (e.g., the processor 120 of FIG. 1 or the controller 511 of FIG. 5), a voltage detection unit 1417, a first transistor 1419, a USB switch module 1421, a charging module 1423, and a booster 1425 (e.g., a 5V booster). Further, a circuit of the first component 1401 can be configured to be identical to the circuit of the first component 1301 of FIG. 13. In the first component 1401, when power 1431 supplied from the battery cell 1429 is supplied through connection pins (e.g., a POGO_V_BATT pin) of the first connection pin and the second connection pin, the power 1431 is applied to the processor 1415 and the booster 1425. When a voltage is applied to the booster 1425, a current 1435 is supplied to the battery cell 1411 through a connected charging module 1423, so that the battery cell 1411 can be charged. As illustrated in FIG. 14, the second component 1403 includes the charging module 1431 and the battery cell 1429, and may further include at least one resistor. The charging module 1431 includes at least one transistor therein, and is connected to the battery cell 1429 and the pins (a POGO_VBUS pin and a POGO_V_BATT pin) of the second connection pin.

Referring back to FIG. 12, in step 1207, the power supplied from the internal battery to the processor is interrupted as the first component receives external power.

Referring to FIG. 14, when the second component 1403 is attached to the first component 1401, the first component 1401 interrupts a current applied to the battery switch module 1413 through the POGO_V_BATT pin, such that a current is not applied to the battery cell 1411, and separates the battery cell 1411 from the processor 1415. Further, when being separated from the second component 1403, the first component 1401 connects one terminal (e.g., a G terminal) of the battery switch module 1413 to the voltage detection unit 1417 through the second transistor 1419, and connects other terminals (e.g., D and S terminals) of the battery switch module 1413 to the processor 1415 and the battery cell 1411, respectively.

Referring back to FIG. 12, in step 1209, the first component operates the electronic device and charges the internal battery, using the external power (e.g., operating power) supplied from the second component.

Referring to FIG. 14, when the power 1431 is applied from the charging module 1429 of the second component 1403 through the POGO_V_BATT pin, voltage is applied to each of the processor 1415 and the booster 1425, and accordingly, power 1433 is applied to the processor 1415, and power 1435 is additionally applied to the battery cell 1411 through the booster 1425.

Accordingly, in the present disclosure, when outputting sound by operating the first audio module, the first component identifies a state of the necklace band connected to the housing, an earphone for outputting sound. When the second component is separated from the first, component, it can be identified that the first line of the necklace band is connected and the second line thereof is interrupted, and the audio signal is output through only the first line. When the second component is coupled, the first component outputs an audio signal through the first line directly connected thereto and the second line connected to the second component.

Accordingly, the first component of the electronic device can be operated by power supplied from the internal battery or external power supplied from the second component according to whether the second component is attached or detached.

Further, according to an embodiment of the present disclosure, at least one other external component (e.g., the third component) can be coupled between the first component and the second component of the electronic device, and power can be supplied through the coupled third component.

Figure 15:
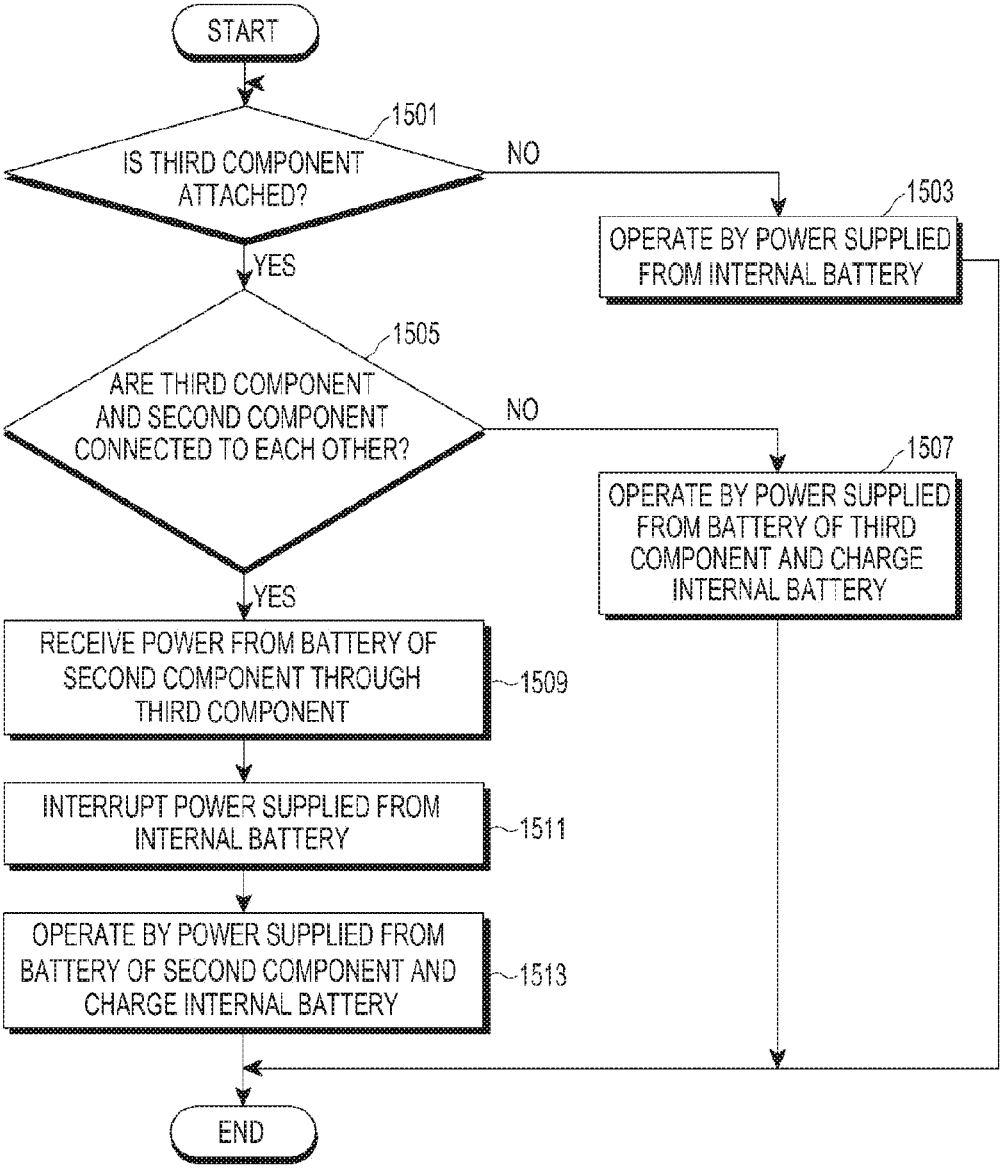
FIG. 15 is a flowchart of a procedure of operating an electronic device, according to an embodiment of the present disclosure.
Figure 16:
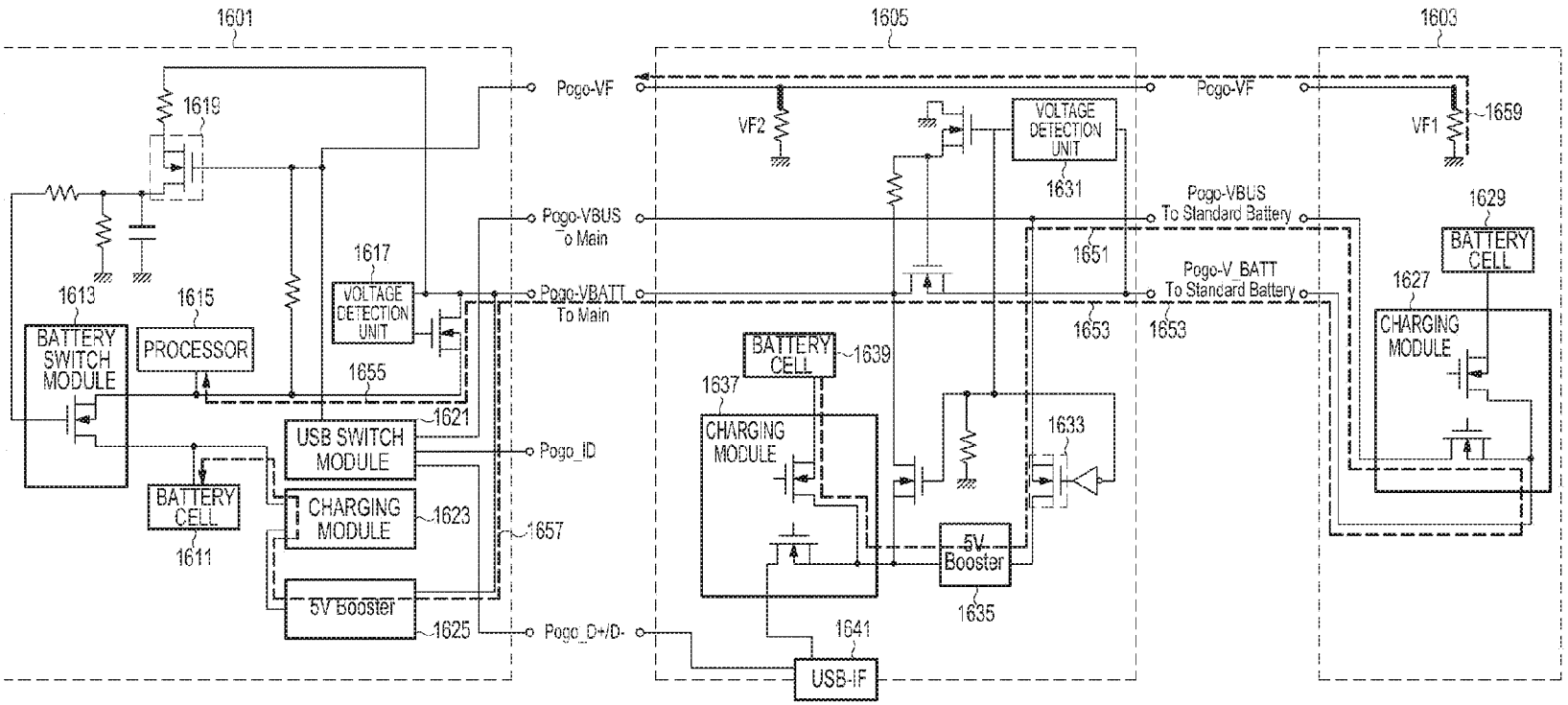
FIGS. 16, 17, and 18 illustrate configurations of a circuit of an electronic device, according to various embodiments of the present disclosure.
Figure 17:
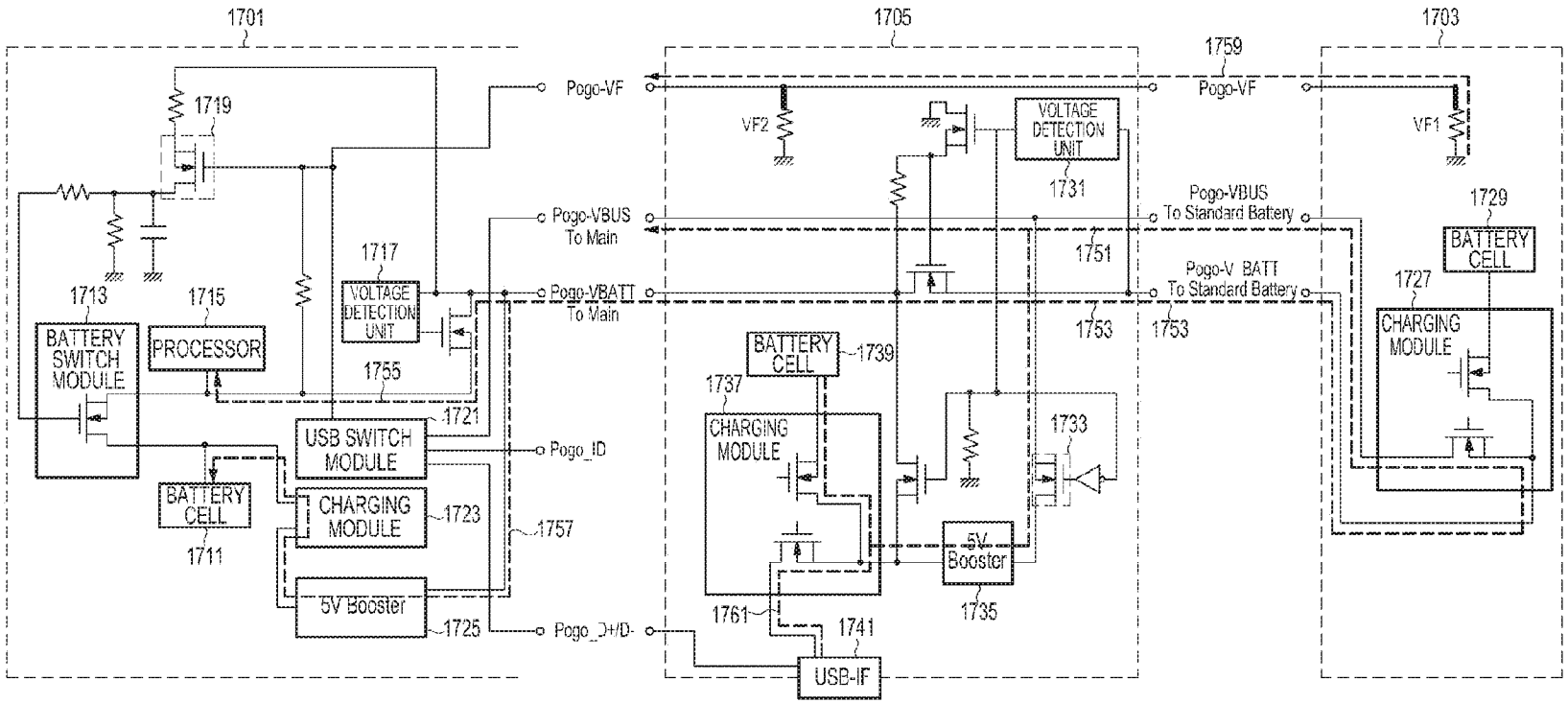
Figure 18:
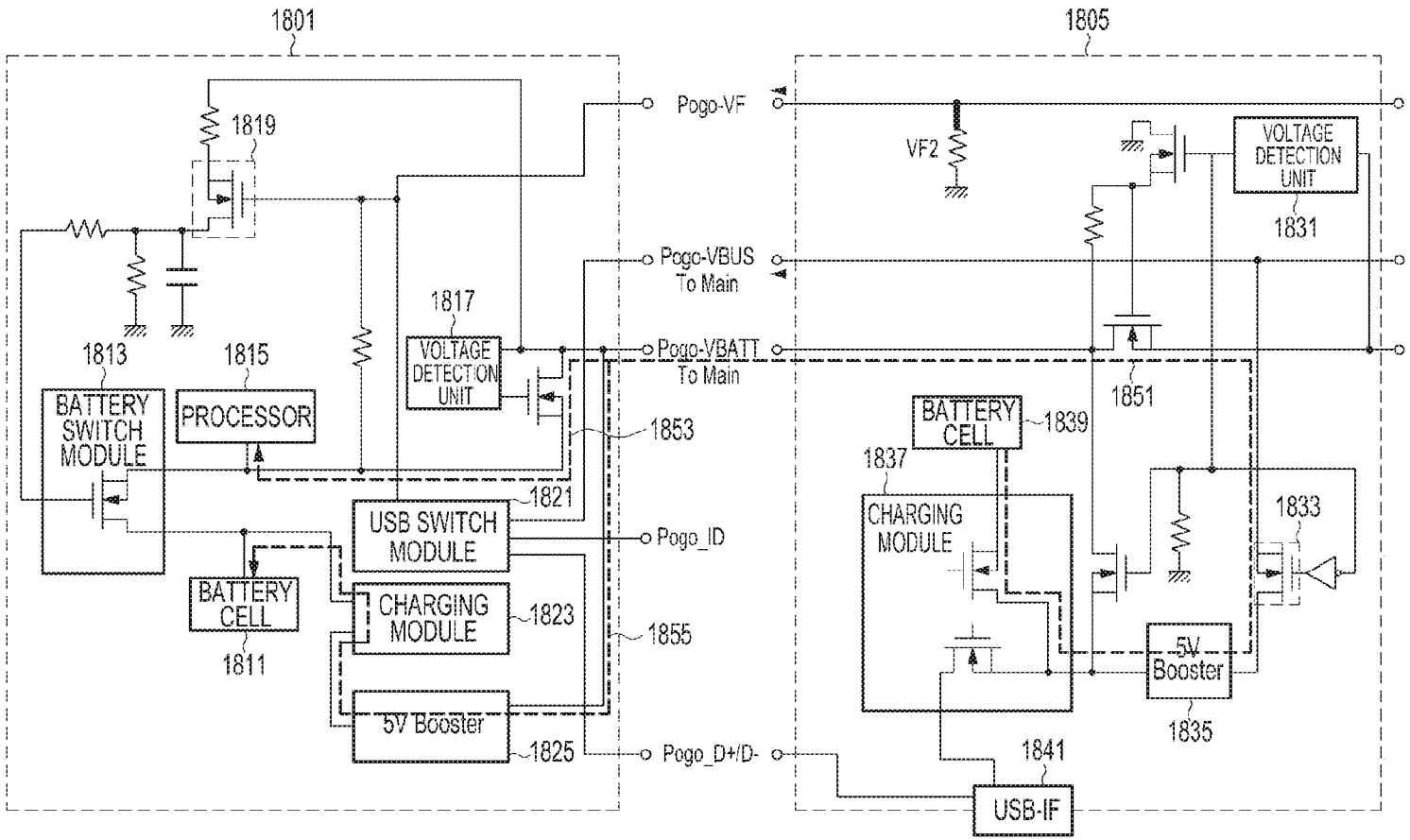

FIG. 15 is a flowchart of a procedure of operating an electronic device, according to an embodiment of the present disclosure. FIGS. 16 to 18 illustrates configurations of a circuit of an electronic device, according to various embodiments of the present disclosure.

Referring to FIGS. 15 to 18, one housing of a housing of a third component is attached to one surface of a housing of a first component (e.g., the first component 501 of FIG. 5) of an electronic device (e.g. the electronic device 101 of FIG. 1), and the other surface of the third component can be attached to one surface of a second component (e.g., the second component 503 of FIG. 5).

Referring to FIG. 15, in step 1501, the electronic device determines whether the third component is attached to the first component. According to an embodiment, the first component can determine whether the second component is coupled, by identifying a connection state of the second line of the necklace band. For example, it can be identified that the first component and the second component are separated from each other, by identifying that a connection between a first connection unit (e.g., the first connection unit 512 of FIG. 5) and a second connection unit (e.g., the second connection unit 522 of FIG. 5) is interrupted in a path through which the audio signal is transmitted, according to a transmission failure of the audio signal to be transmitted to the second line. Further, according to another an embodiment, the first component can determine whether the second component is separated therefrom, by identifying whether external power is supplied.

Referring to FIG. 16, according to one embodiment of the present disclosure, a first component 1601 (e.g. the first component 501 of FIG. 5) can determine whether a third component 1605 is coupled or separated, on the basis of a resistance value according to a forward voltage VF 1659 of a connection pin (e.g., a POGO-VF pin) of a connection unit.

Referring back to FIG. 15, when it can be identified in step 1501 that the third component is not attached, the first component can be operated by power supplied from the internal battery, in step 1503, and the electronic device performs step 1501 again. Further, the first component can determine whether the third component is attached, while performing the procedure described in FIG. 12.

When it is identified in step 1501 that the third component is attached, the electronic device performs step 1505.

In step 1505, it is identified whether the first component of the electronic device is attached to the third component and the second component. When it is identified that the second component and the third component are attached to each other, the electronic device performs step 1509, and when the second component and the third component are not attached to each other, the electronic device performs step 1507.

In step 1507, the first component receives power from the battery of the third component, operates the electronic device using the received power, and charges the internal battery using the received power. Further, the first component performs step 1501 again, so as to determine whether the third component is attached.

In step 1509, the first component of the electronic device receives power from a battery of the second component through the third component.

In step 1511, the power supplied from the internal battery is interrupted as the first component receives external power.

Referring to FIG. 16, the first component 1601 interrupts a connection between the battery cell 1611 corresponding to the internal battery and the battery switch module 1613 when the third component 1605 is attached thereto, and connects the battery switch module 1613 to the battery cell 1611 when the second component 1603 is separated therefrom. The first component 160 includes at least one of a battery cell 1611 (e.g., the internal battery 513 of FIG. 5) corresponding to an internal battery, a battery switch module 1613, a processor 1615 (e.g., the processor 120 of FIG. 1 or the controller 511 of FIG. 5), a voltage detection unit 1617, a first transistor 1619, a USB switch module 1621, a charging module 1623 and a booster 1625 (e.g., a 5V booster). Further, a circuit of the first component 1601 can be configured to be identical to the circuit of the first component 1301 of FIG. 13. The second component 1603 includes at least one of a charging module 1627, a battery cell 1629, and at least one resistor. The third component 1605 includes a voltage detection unit 1631 for identifying a voltage applied to a pin (e.g., a POGO_V_BATT pin) of a third connection unit connected to a first or second connection unit, a first transistor 1633, a booster 1635, a charging module 1637, a battery cell 1639, and a USB interface 1641. Further, the third component 1605 may include at least one of a plurality of resistors and a plurality of other transistors. The first component 1601 can interrupt current applied to the battery switch module 1613 through the POGO_V_BATT pin such that the current is not applied to the battery cell 1611, and separate the battery cell 1611 from the processor 1615. When being separated from the second component 1601, the first component 1603 connects one terminal (e.g., a G terminal) of the battery switch module 1613 to the voltage detection unit 1619 through the second transistor 1617, and connects other terminals (e.g., D and S terminals) of the battery switch module 1413 to the processor 1615 and the battery cell 1611, respectively.

Referring back to FIG. 15, in step 1513, the first component of the electronic device operates the electronic device using power supplied from the battery of the second component, and charges the internal battery.

Referring to FIG. 16, the second component 1603 receives external power 1651 from the third component 1605 by electrically connecting a connection pin POGO_BUS pin) of a connection unit and a pin (e.g., a POGO_BUS pin) of a connection unit connected to the charging module 1627 of the third component 1605. Further, when the received external power 1651 is applied to the charging module 1627, the second component 1603 charges the battery cell 1629 by applying the external power 1651 to the battery cell 1629 by the charging module 1627. Further, the second component 1603 applies the power 1651 supplied by the battery cell 1629 to the pin (e.g., the POGO_V_BATT pin) of the connection unit of the third component 1605 through the pin (e.g., the POGO_V_BATT pin) of the connection unit connected to the charging module 1627. The third component 1605 can supply, to the first component 1601, the power 1653 supplied from the second component 1603, through the pin (e.g., the POGO_V_BATT pin) of the connection unit, through bypassing. When the power 1653 is supplied to the first component 1601 through the pin (POGO_V_BATT pin) of the input connection unit, the first component 1601 applies the power 1655 to the internal processor 1615, and applies the power 1657 to the battery cell, which is an internal battery, via the booster 1625 and the charging module 1623.

Referring to FIG. 17, according to another embodiment of the present disclosure, a first component 1701 (e.g., the first component 501 of FIG. 5) includes at least one of a battery cell 1711 (e.g., the internal battery 513 of FIG. 5), corresponding to an internal battery, a battery switch module 1713, a processor 1715 (e.g., the processor 120 of FIG. 1 or the controller 511 of FIG. 5), a voltage detection unit 1717, a first transistor 1719, a USB switch module 1721, a charging module 1723, and a booster 1725 (e.g., a 5V booster). Further, a circuit of the first component 1701 can be configured to be identical to the circuit of the first component 1301 of FIG. 13.

The first component 1701 receives, via a third component 1705, power supplied from a charged battery cell 1729 (e.g., the battery 521 of FIG. 5) of the second component 1703 (e.g., the second component 503 of FIG. 5). The second component 1703 charges the battery cell 1729 by receiving external power 1751 from the third component 1705 and applying the received external power 1751 to the battery cell 1729 by the charging module 1727. Further, the third component 1705 includes a voltage detection unit 1731 for identifying a voltage applied to a pin (e.g., a POGO_V_BATT pin) of a third connection unit connected to a first or second connection unit, a first transistor 1733, a booster 1735, a charging module 1737, a battery cell 1739, and a USB interface 1741, and may further include at least one of a plurality of resistors and a plurality of other transistors.

The third component 1705 receives power 1761 from an external device through the USB port 1741 to supply the power 1751 to the second component 1703 through the charging module 1737, the booster 1735 and the transistor 1733 for controlling power, and charges the battery cell 1739, which is an internal battery, using the power 1761 received from the external device. Further, the third component 1705 transmits/receives data to/from the external device through the USE port 1741. Further, the third component 1705 transmits/receives data to/from the first component 1701 by electrically connecting data connection pins D+ and D− connected to the USE port 1741 and data connection pins D+ and D− of the first component 1701 to each other.

Referring to FIG. 18, according to another embodiment of the present disclosure, one surface of a housing of a third component 1805 is attached to one surface of a housing of the first component 1801 (e.g., the first component 501 of FIG. 5) and other components (e.g., a second component) may not be attached to the other surface of the housing of the third component 1805, as in step 1507. In this case, the first component 1801 receives power through an electrically-connected connection unit from the third component 1805. The third component 1805 may be a subject for supplying power, which is similar to the second component (e.g., the second component 503 of FIG. 5). The first component 1801 includes at least one of a battery cell 1811 (e.g., the internal battery 513 of FIG. 5) corresponding to an internal battery, a battery switch module 1813, a processor 1815 (e.g., the processor 120 of FIG. 1 or the controller 511 of FIG. 5), a voltage detection unit 1817, a first transistor 1819, a USE switch module 1821, a charging module 1823 and a booster 1825 (e.g., a 5V booster). Further, a circuit of the first component 1801 can be configured to be identical to the circuit of the first component 1301 of FIG. 13. The third component 1805 includes a voltage detection unit 1831 for identifying a voltage applied to a pin (e.g., a POGO_V_BATT pin) of a connection unit, a first transistor 1833, a booster 1835, a charging module 1837, a battery cell 1839, and a USE interface 1841, and may further include at least one of a plurality of resistors and a plurality of other transistors.

The third component 1805 applies current charged in the battery cell 1839 thereof to a voltage input connection pin (POGO_V_BATT pin) of the first component 1801, so as to supply power 1851 to the first component 1801. When the power 1815 is supplied to the first component 1801, the first component 1801 applies the power 1853 to the internal processor 1825 through the input connection pin (POGO_V_ BATT pin), and applies the power 1855 to the battery cell, which is an internal battery, via the booster 1825 and the charging module 1823. Further, since the first component 1801 receives the power 1851 from the third component 1805, a user can disconnect a connection between the battery switch module 1813 and the battery cell 1811, so as to interrupt power supplied from the battery cell 1811.

A method of operating an electronic device according to one of an embodiment of the present disclosure includes connecting a first connection unit included in a first component of an electronic device and a second connection unit included in a second component, when the first component is attached to the second component using a first magnet of the first component and a second magnet of the second component, and receiving, by the first connection unit of the first component, power from the second connection unit of the second component.

According to an embodiment, the method may further include interrupting power supplied from an internal battery of the first component when the first component is attached to the second component by the first magnet and the second magnet, and charging a control to provide the power applied from the second component and to charge the internal battery.

According to an embodiment, the method may further include transmitting an audio signal to the necklace band connected to the first component and the second component.

According to an embodiment, the transmitting of the audio signal includes outputting an audio signal to a first external speaker connected to a first line of the necklace band, and outputting the audio signal to the second component connected to a second line connected to a second external speaker of the necklace band.

According to an embodiment, the method may further include receiving power from a third component when the second component is detached from first component and the third detachable component is attached to the first component.

According to an embodiment of the present disclosure, the method may further include receiving the power from an internal battery of the second component charged by the power supplied from the third component, when the second component is detached from the first component and the third component is attached to the first component and the second component.

According to an embodiment of the present disclosure, the method may further include transmitting and receiving data to and from an external device when the third component is attached to the first component.

According to an embodiment of the present disclosure, the method may further include determining whether the second component is attached to the first component based on a connection state of the second line of the necklace band.

According to an embodiment of the present disclosure, the method may further include determining whether the second component is attached to the first component based on a resistance value identified according to a voltage applied to the first component.

Figure 19:
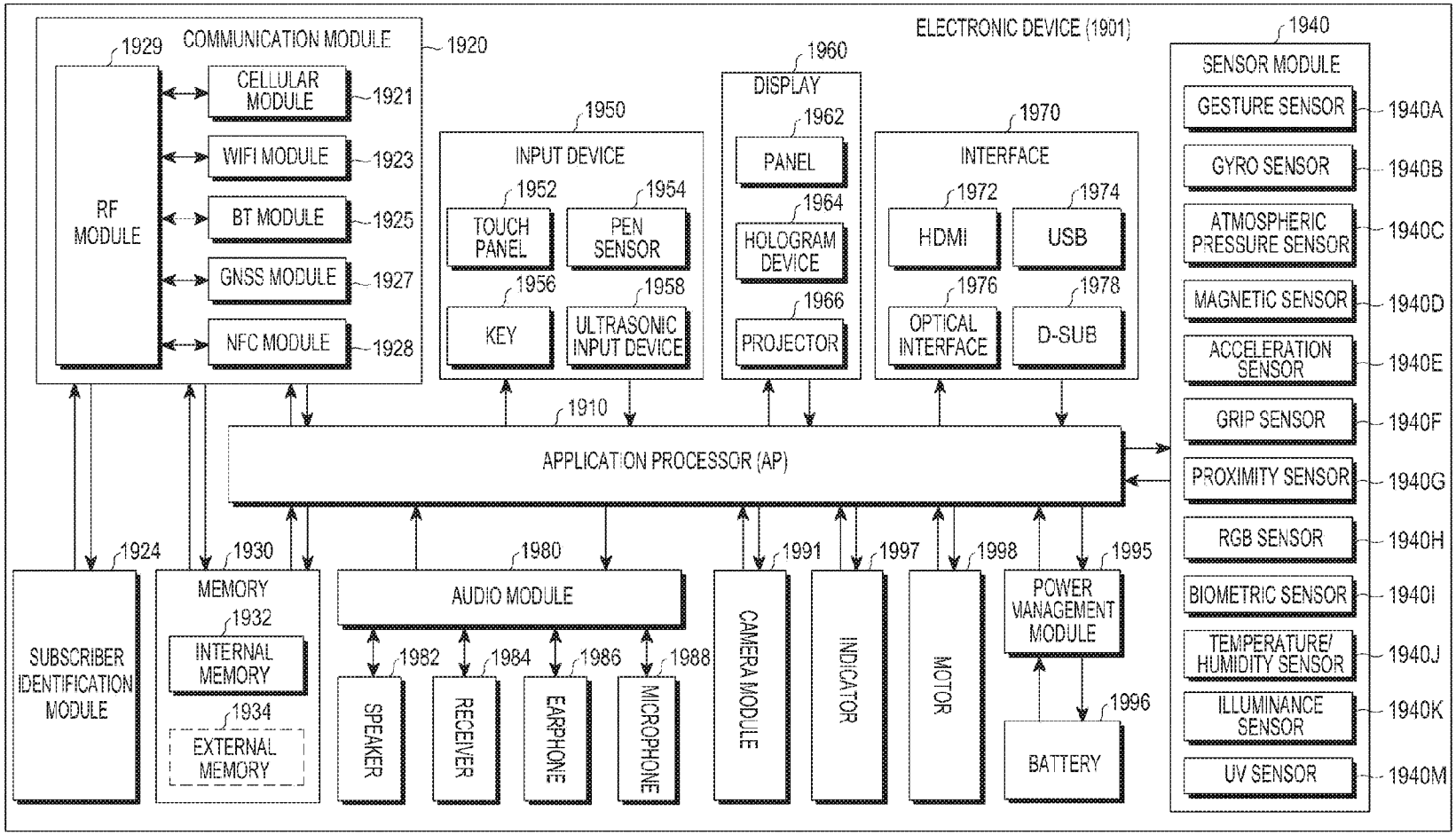
FIG. 19 is a block diagram of a configuration of an electronic device, according to an embodiment of the present disclosure.

FIG. 19 is a block diagram of a configuration of an electronic device, according to an embodiment of the present disclosure.

Referring to FIG. 19, and electronic device 1901 may include the whole or part of the electronic device 101 illustrated in FIG. 1. The electronic device 1901 includes at least one application processor (AP) 1910, a communication module 1920, a subscriber identification module (SIM) card 1924, a memory 1930, a sensor module 1940, an input device 1950, a display 1960, an interface 1970, an audio module 1980, a camera module 1991, a power management module 1995, a battery 1996, an indicator 1997, and a motor 1998.

The processor 1910 controls a plurality of hardware or software components connected to the processor 1910 by driving an operating system or an application program and perform the processing of various pieces of data and calculations. The processor 1910 may be implemented by, for example, a System on Chip (SoC). According to an embodiment, the processor 1910 may further include a Graphic Processing Unit (GPU) and/or an image signal processor. The processor 1910 may include at least some (e.g., cellular module 1921) of the other components illustrated in FIG. 19. The processor 1910 loads, into a volatile memory, instructions or data received from at least one (e.g., a non-volatile memory) of the other components and processes the loaded instructions or data, and stores various pieces of data in a non-volatile memory.

The communication module 1920 may have a configuration equal or similar to that of the communication interface 170 of FIG. 1. The communication module 1920 includes a cellular module 1921, a Wi-Fi module 1923, a Bluetooth module 1925, a GNSS module 1927 (e.g., a GPS module, a Glonass module, a Beidou module, or a Galileo module), an NFC module 1928, and a Radio Frequency (RF) module 1929.

The cellular module 1921 provides a voice call, an image call, a text message service, or an Internet service through a communication network. According to an embodiment, the cellular module 1921 may distinguish between and authenticate electronic devices 1901 within a communication network using the SIM card 1924. According to an embodiment, the cellular module 1921 performs at least some of functions that the processor 1910 can provide. According to an embodiment, the cellular module 1921 includes a Communication Processor (CP).

The Wi-Fi module 1923, the Bluetooth module 1925, the GNSS module 1927, or the NFC module 1928 may include a processor for processing data transmitted and received through the corresponding module. According to some embodiments, at least some of the cellular module 1921, the Wi-Fi module 1923, the Bluetooth module 1925, the GNSS module 1927, and the NFC module 1928 may be included in one Integrated Chip (IC) or IC package.

The RF module 1929 transmits/receives a communication signal (for example, an RF signal). The RF module 1929 may include a transceiver, a Power Amp Module (PAM), a frequency filter, a Low Noise Amplifier (LNA), or an antenna. According to another embodiment, at least one of the cellular module 1921, the Wi-Fi module 1923, the Bluetooth module 1925, the GNSS module 1927, and the NFC module 1928 transmits and receives RF signals through a separate RF module.

The SIM card 1924 may be a card or an embedded SIM, and contains unique identification information (e.g., an Integrated Circuit Card Identifier (ICCID)) or subscriber information (e.g., an International Mobile Subscriber Identity (IMSI)).

The memory 1930 (for example, the memory 130) may include an internal memory 1932 or an external memory 1934.

The internal memory 1932 may include at least one of a volatile memory (for example, a Dynamic Random Access Memory (DRAM), a Static RAM (SRAM), a Synchronous Dynamic RAM (SDRAM), and the like) and a non-volatile memory (for example, a One Time Programmable Read Only Memory (OTPROM), a Programmable ROM (PROM), an Erasable and Programmable ROM (EPROM), an Electrically Erasable and Programmable ROM (EEPROM), a mask ROM, a flash ROM, a flash memory (for example, a NAND flash memory or a NOR flash memory), a hard disc drive, or a Solid State Drive (SSD).

The external memory 1934 may include a flash drive a Compact Flash (CF), a Secure Digital (SD), a Micro Secure Digital (Micro-SD), a Mini Secure Digital (Mini-SD), air eXtreme Digital (xD), a Multi-Media Card (MMC), a memory stick, etc. The external memory 1934 can be functionally and/or physically connected to the electronic device 1901 through various interfaces.

The sensor module 1940 measures a physical quantity or detects an operation state of the electronic device 1901, and converts the measured or detected information into an electrical signal. The sensor module 1940 may include at least one of a gesture sensor 1940A, a gyro sensor 1940B, an atmospheric pressure sensor 1940C, a magnetic sensor 1940D, an acceleration sensor 1940E, a grip sensor 1940F, a proximity sensor 19400, a red, green, blue (RGB) sensor 19401, a biometric sensor 19401, a temperature/humidity sensor 1940J, a light sensor 1940K, and a ultraviolet (UV) sensor 1940M. Additionally or alternatively, the sensor module 1940 may include an E-nose sensor, an electromyography (EMG) sensor, an electroencephalogram (EEG) sensor, an electrocardiogram (ECG) sensor, an Infrared (IR) sensor, an iris sensor, and/or a fingerprint sensor. The sensor module 1940 may further include a control circuit for controlling one or more sensors included therein. In some embodiments, the electronic device 1901 may further include a processor configured to control the sensor module 1940 as a part of or separately from the processor 1910, and controls the sensor module 1940 while the processor 1910 is in a sleep state.

The input device 1950 may include a touch panel 1952, a (digital) pen sensor 1954, a key 1956, and an ultrasonic input device 1958.

The touch panel 1952 may use at least one of a capacitive scheme, a resistive scheme, an infrared scheme, and an ultrasonic scheme. Further, the touch panel 1952 may further include a control circuit. The touch panel 1952 may further include a tactile layer and provide a tactile reaction to the user.

The (digital) pen sensor 1954 may include a recognition sheet which is a part of the touch panel or is separated from the touch panel.

The key 1956 may include a physical button, an optical key or a keypad.

The ultrasonic input device 1958 detects an ultrasonic wave generated by an input tool through a microphone 1988 and identifies data corresponding to the detected ultrasonic waves.

The display 1960 (for example, the display 160) may include a panel 1962, a hologram device 1964 or a projector 1966.

The panel 1962 may include a configuration identical or similar to that of the display 160 illustrated in FIG. 1. The panel 1962 can be implemented to be flexible, transparent, or wearable. The panel 1962 and the touch panel 1952 can be implemented as one module.

The hologram apparatus 1964 displays a three dimensional image in the air by using an interference of light.

The projector 1966 displays an image by projecting light onto a screen. The screen may be located in the interior of or on the exterior of the electronic device 1901. According to an embodiment, the display 1960 may further include a control circuit for controlling the panel 1962, the hologram device 1964, or the projector 1966.

The interface 1970 may include a High-Definition Multimedia Interface (HDMI) 1972, a Universal Serial Bus (USB) 1974, an optical interface 1976, or a D-subminiature (D-sub) 1978. The interface 1970 may be included in the communication interface 170 illustrated in FIG. 1. Additionally or alternatively, the interface 1970 may include a Mobile High-definition Link (MHL) interface, a Secure Digital (SD) card/Multi-Media Card (MMC) interface, or an Infrared Data Association (IrDA) standard interface.

The audio module 1980 bilaterally converts a sound and an electrical signal. At least some components of the audio module 1980 may be included in the input/output interface 145 illustrated in FIG. 1. The audio module 1980 processes sound information which is input or output through a speaker 1982, a receiver 1984, earphones 1986, or the microphone 1988.

The camera module 1991 photographs a still image and a dynamic image. According to an embodiment, the camera module 291 may include one or more image sensors (for example, a front sensor or a back sensor), a lens, an Image Signal Processor (ISP) or a flash (for example, LED or xenon lamp).

The power management module 1995 manages power of the electronic device 1901. According to an embodiment, the power management module 1995 may include a Power Management Integrated Circuit (PMIC), a charger Integrated Circuit (IC), or a battery gauge. The PMIC may use a wired and/or wireless charging method. Examples of the wireless charging method may include a magnetic resonance method, a magnetic induction method, an electromagnetic method, and the like. Additional circuits (e.g., a coil loop, a resonance circuit, a rectifier, etc.) for wireless charging may be further included. The battery gauge measures a residual quantity, a voltage, a current, or a temperature during the charging of the battery 1996. The battery 1996 may include a rechargeable battery or a solar battery.

The indicator 1997 indicates a particular state (e.g., a booting state, a message state, a charging state, etc) of the electronic apparatus 1901 or a part (e.g., the processor 1910) thereof.

The motor 199 converts an electrical signal into a mechanical vibration, and generates a vibration, a haptic effect, etc.

The electronic apparatus 1901 may include a processing unit (e.g., a GPU) for supporting a mobile television (TV). The processing unit for supporting mobile TV processes media data according to a standard such as Digital Multimedia Broadcasting (DMB), Digital Video Broadcasting (DVB), or mediaFLO™.

According to an embodiment of the present disclosure, each of the above-described component elements of hardware may be configured with one or more components, and the names of the corresponding component elements may vary based on the type of electronic device. The electronic device of the present disclosure may include at least one of the aforementioned elements. Some elements may be omitted or other additional elements may be further included in the electronic device. Also, some of the hardware components may be combined into one entity, which may perform functions identical to those of the relevant components before the combination.

Figure 20:
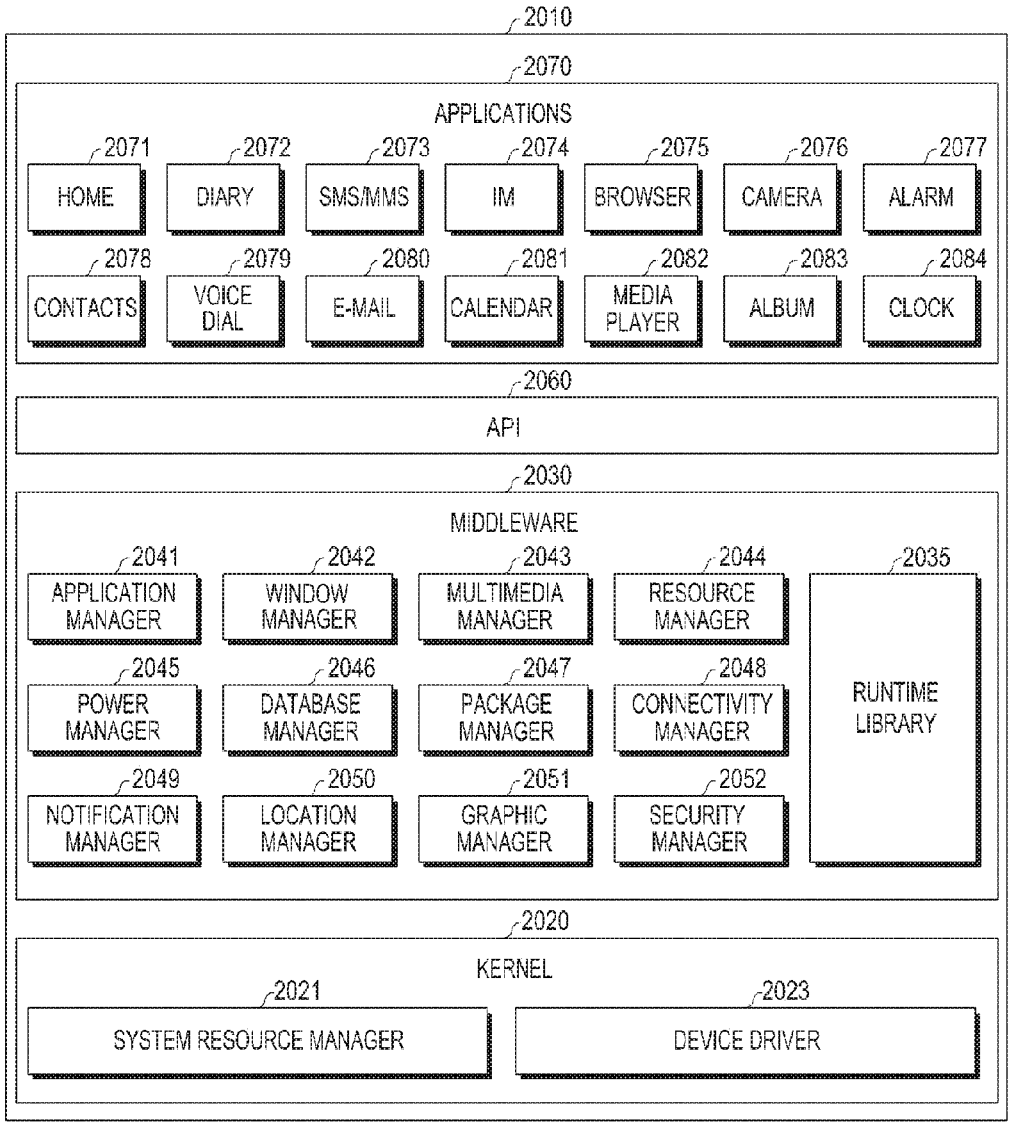
FIG. 20 is a block diagram of a configuration of a program module of an electronic device, according to an embodiment of the present disclosure.

FIG. 20 is a block diagram of a program module of an electronic device, according to an embodiment of the present disclosure.

Referring to FIG. According to an embodiment, a program module 2010 (for example, the program 140) includes an Operating System (OS) for controlling resources related to the electronic device (for example, the electronic device 101) and/or various applications (for example, the application programs 147) running on the operating system. The operating system may be, for example, Android, iOS, Windows, Symbian, Tizen, Bada, etc.

The program module 2010 includes a kernel 2020, middleware 2030, an Application Programming Interface (API) 2060, and/or an application 2070. At least some of the program module 2010 can be preloaded on the electronic device, or can be downloaded from an external electronic device (e.g., the external electronic device 102 or 104, or the server 106).

The kernel 2020 (for example, the kernel 141) may include a system resource manager 2021 and/or a device driver 2023.

The system resource manager 2021 controls, assigns, or collects system resources. According to an embodiment, the system resource manager 2021 may include a process manager, a memory manager, or a file system manager.

The device driver 2023 may include a display driver, a camera driver, a Bluetooth driver, a shared memory driver, a USB driver, a keypad driver, a Wi-Fi driver, an audio driver, or an Inter-Process Communication (IPC) driver.

The middleware 2030 provides a function commonly required by the applications 2070, or provides various functions to the applications 2070 through the API 2060 so that the applications 2070 can efficiently use limited system resources within the electronic device. According to an embodiment, the middleware 2030 (e.g., the middleware 143) may include at least one of a runtime library 2035, an application manager 2041, a window manager 2042, a multimedia manager 2043, a resource manager 2044, a power manager 2045, a database manager 2046, a package manager 2047, a connectivity manager 2048, a notification manager 2049, a location manager 2050, a graphic manager 2051, and a security manager 2052.

The runtime library 2035 is a library module that a compiler uses in order to add new functions through a programming language while the applications 2070 are executed. The runtime library 2035 performs input/output management, memory management, or a function for an arithmetic function.

The application manager 2041 manages a life cycle of at least one of the applications 2070.

The window manager 2042 manages Graphical User Interface (GUI) resources used on a screen.

The multimedia manager 2043 identifies formats required for the reproduction of various media files and encode or decode a media file using a codec suitable for the corresponding format.

The resource manager 2044 manages resources of at least one of the applications 2070, such as a source code, a memory, and a storage space.

The power manager 2045 operates together with a basic input/output system (BIOS) to manage a battery or power and provides power information required for the operation of the electronic device.

The database manager 2046 generates, searches, or changes a database to be used in at least one of the applications 2070.

The package manager 2047 manages the installation or the updating of an application distributed in the form of a package file.

The connectivity manager 2048 manages a wireless connection such as Wi-Fi or Bluetooth.

The notification manager 2049 displays or notifies of an event, such as an arrival message, an appointment, proximity notification, etc., in such a manner as to not disturb a user.

The location manager 2050 manages location information of the electronic device.

The graphic manager 2051 manages a graphic effect to be provided to a user and a user interface relating to the graphic effect.

The security manager 2052 provides all security functions required for system security or user authentication.

According to an embodiment, when the electronic device (for example, the electronic device 101) has a phone call function, the middleware 2030 may further include a telephony manager for managing a voice call function or a video call function of the electronic device.

The middleware 2030 may include a middleware module that forms combinations of various functions of the above-described components. The middleware 2030 can provide specialized modules according to types of operating systems in order to provide differentiated functions. Further, the middleware 2030 can dynamically remove some of the existing components, or can add new components.

The API 2060 (e.g., the API 145) is a set of API programming functions, and can be provided with a different configuration according to an OS. For example, in the case of Android or iOS, one API set may be provided for each platform, and in the case of Tizen, two or more API sets may be provided for each platform.

The applications 2070 (e.g., the application programs 147) may include one or more applications that provide functions, such as home 2071, dialer 2072, SMS/MS 2073, Instant Message (IM) 2074, browser 2075, camera 2076, alarm 2077, contacts 2078, voice dial 2079, email 2080, calendar 2081, media player 2082, album 2083, clock 2084. The applications 2070 may additionally include applications which provide health care (e.g., measure exercise quantity or blood sugar), or environment information (e.g., atmospheric pressure, humidity, or temperature information).

According to an embodiment, the applications 2070 includes an information exchange application, supporting information exchange between the electronic device 101 and the external electronic device 102 or 104. The application associated with exchanging information may include a notification relay application for notifying an external electronic device of certain information or a device management application for managing an external electronic device.

For example, the notification relay application includes a function of transferring, to the external electronic device (e.g., the external electronic device 102 or 104), notification information generated from other applications of the electronic device 101 (e.g., SMS/MMS application, an e-mail application, a health management application, or an environmental information application). Further, the notification relay application receives notification information from the external electronic device and provides the received notification information to the user.

The device management application manages (for example, installs, deletes, or updates) at least one function of the external electronic device 102 or 104 communicating with the electronic device (for example, a function of turning on/off the external electronic device itself (or some components) or a function of adjusting luminance (or a resolution) of the display), applications operating in the external electronic device, or services provided by the external electronic device (for example, a call service and a message service).

According to an embodiment, the applications 2070 may include applications (for example, a health care application of a mobile medical appliance) designated according to attributes of the external electronic device 102 or 104.

According to an embodiment, the application 2070 may include an application received from the external electronic device (e.g., the server 106, or the external electronic apparatus 102 or 104).

According to an embodiment, the applications 2070 may include a preloaded application or a third party application which can be downloaded from the server.

Names of the elements of the program module 2010, according to the above-described embodiments of the present disclosure, may change depending on the type of OS.

According to various embodiments of the present disclosure, at least some of the program module 2010 may be implemented in software, firmware, hardware, or a combination of two or more thereof. At least some of the program module 2010 may be implemented (e.g., executed) by the processor (e.g., the processor 1410). At least some of the program module 2010 may include a module, a program, a routine, a set of instructions, and/or a process for performing one or more functions.

The term "module", as used herein, may refer to a unit including one of hardware, software, and firmware or a combination of two or more of them. The term "module" may be interchangeably used with the terms "unit", "logic", "logical block", "component", or "circuit". The "module" may be a minimum unit of art integrated component element or a part thereof. The "module" may be a minimum unit for performing one or more functions or a part thereof. The "module" may be mechanically or electronically implemented. The "module" according to the present disclosure may include at least one of an Application-Specific Integrated Circuit (ASIC) chip, a Field-Programmable Gate Arrays (FPGA), and a programmable-logic device for performing operations which has been known or are to be developed hereinafter.

At least some of the devices (for example, modules or functions thereof) or the method (for example, operations) according to the present disclosure may be implemented by an instruction stored in a computer-readable storage medium in a programming module form. The instruction, when executed by a processor (e.g., the processor 120), may cause the one or more processors to execute the function corresponding to the instruction. The computer-readable storage medium may be the memory 130.

The computer readable recoding medium may include a hard disk, a floppy disk, magnetic media (e.g., a magnetic tape), optical media (e.g., a Compact Disc Read Only Memory (CD-ROM) and a Digital Versatile Disc (DVD)), magneto-optical media (e.g., a floptical disk), a hardware device (e.g., a Read Only Memory (ROM), a Random Access Memory (RAM), a flash memory), and the like. In addition, the program instructions may include high level language codes, which can be executed in a computer by using an interpreter, as well as machine codes made by a compiler. The aforementioned hardware device may be configured to operate as one or more software modules in order to perform the operation of the present disclosure, and vice versa.

The programming module 2010 may include one or more of the aforementioned components or may further include other additional components, or some of the aforementioned components may be omitted. Operations executed by a module, a programming module, or other component elements may be executed sequentially, in parallel, repeatedly, or in a heuristic manner. Further, some operations may be executed according to another order or may be omitted, or other operations may be added.

According to an embodiment, provided is a computer-readable recording medium in which a program to run on a computer is recorded, wherein, when being executed by a processor, the program includes a command allowing the processor to perform connecting a first connection unit included in a first component of an electronic device and a second connection unit included in a second component that is attached to the first component using a first magnet of the first component and a second magnet of the second component, and receiving, by the first connection unit of the first component, power from the second connection unit of the second component.

The various embodiments disclosed herein are provided merely to easily describe technical details of the present disclosure and to help the understanding of the present disclosure, and are not intended to limit the scope of the present disclosure. Accordingly, the scope of the present disclosure should be construed as including all modifications or various other embodiments based on the technical idea of the present disclosure. Therefore, the scope of the present disclosure is defined not by the detailed description and embodiments, but by the following claims and their equivalents.

What is claimed is:

1. An electronic device comprising:

a necklace band; and a first component connected to the necklace band, wherein the first component comprises:

a first magnet located on a first surface of a housing of the first component, a first connection unit located on the first surface of the housing of the first component, and electrically connectable to a second connection unit located on the first surface of a housing of a second component, and a controller configured to connect the first connection unit and the second connection unit when the first magnet is attached to a second magnet located on the first surface of the housing of the second component, and receive power from a battery of the second component through the first connection unit connected with the second connection unit.

2. The electronic device of claim 1, wherein the first component further comprises an internal battery that is charged by the received power, and supplies power for operating the electronic device when the second component is detached from the first component.

3. The electronic device of claim 1, wherein the first component further comprises an audio module for transmitting an audio signal to the necklace band.

4. The electronic device of claim 3, wherein the audio module comprises a first output unit for outputting the audio signal to a first external speaker of the necklace band, wherein the first output unit is connected to a first line of the necklace band, and transmits the audio signal to the second component including a second output unit, and wherein the second output unit is connected to a second line of the necklace band, and outputs the audio signal to a second external speaker of the necklace band.

5. The electronic device of claim 4, wherein, when the first surface of the third component is attached by the first magnet to the first surface of the first component, the controller controls to be electrically connected to the third component and controls to receive power from a battery of the second component, which is charged by the power supplied from the third component.

6. The electronic device of claim 4, wherein the controller controls to receive power from the third component, when a first surface of the third component is attached by the first magnet to the first surface of the first component and a second surface of the third component is not attached to the first surface of the second component.

7. The electronic device of claim 4, wherein the controller transmits/receives data to/from an external device through the third component by electrically connecting a first connection pin for data transmission and reception of the first connection unit and a third connection pin for data transmission and reception of a third connection unit located on the first surface of the third component, when the third component is attached to the first component.

8. The electronic device of claim 1, wherein the electronic device further comprises:

the second component connected to the necklace band; and a third component configured to supply power to at least one of the first component and the second component, wherein the third component is located between the first component and the second component, electrically connects a third connection unit located on a first surface of the third component to the first connection unit of the first component, when a third magnet located on the first surface of the third component is attached to the first magnet, and electrically connects a fourth connection unit located on a second surface of the third component to the second connection unit of the second component, when a fourth magnet located on the second surface of the third component is attached to the second magnet.

9. The electronic device of claim 1, wherein the controller determines whether the second component is attached to the first component based on a connection state of a second line of the necklace band.

10. The electronic device of claim 1, wherein the controller determines whether the second component is attached to the first component based on a resistance value identified according to a voltage applied to a connection pin for a forward voltage of the first connection unit.

11. A method of operating an electronic device, the method comprising:

connecting a first connection unit included in a first component of an electronic device and a second connection unit included in a second component, when the first component is attached to the second component using a first magnet of the first component and a second magnet of the second component; and receiving, by the first connection unit of the first component, power from a battery of the second component through the second connection unit of the second component.

12. The method of claim 11, further comprising:

interrupting power supplied from an internal battery of the first component, when the first component is attached to the second component by the first magnet and the second magnet; and charging the internal battery by providing the power applied from the second component to the internal battery of the first component.

13. The method of claim 11, further comprising transmitting an audio signal to a necklace band connected to the first component and the second component.

14. The method of claim 13, wherein transmitting the audio signal comprises:

outputting the audio signal to a first external speaker connected to a first line of the necklace band; and outputting the audio signal to the second component connected to a second line connected to a second external speaker of the necklace band.

15. The method of claim 11, further comprising receiving power from a third component, when the second component is detached from first component and the third detachable component is attached to the first component.

16. The method of claim 11, further comprising receiving the power from an internal battery of the second component charged by power supplied from the third component, when the second component is detached from the first component and the third component is attached to the first component and the second component.

17. The method of claim 16, further comprising transmitting and receiving data to and from an external device when the third component is attached to the first component.

18. The method of claim 11, further comprising determining whether the second component is attached to the first component based on a connection state of a second line of the necklace band.

19. The method of claim 11, further comprising determining whether the second component is attached to the first component based on a resistance value identified according to a voltage applied to the first component.

20. A non-transitory computer-readable recording medium having a program recorded thereon, wherein the program comprises executable commands for:

connecting a first connection unit included in a first component of an electronic device and a second connection unit included in a second component that is attached to the first component using a first magnet of the first component and a second magnet of the second component; and receiving, by the first connection unit of the first component, power from a battery of the second component through the second connection unit of the second component.

* * * * *